United States Patent [19]

Tsukase et al.

[11] Patent Number: 4,695,525

[45] Date of Patent: Sep. 22, 1987

[54] IMAGE FORMING PROCESS

[75] Inventors: Masaaki Tsukase; Kozo Sato; Hiroshi Kitaguchi; Masashi Takeuchi; Masatoshi Kato, all of Kanagawa, Japan

[73] Assignee: Fuji Photo Film Co., Ltd., Kanagawa, Japan

[21] Appl. No.: 828,481

[22] Filed: Feb. 12, 1986

[30] Foreign Application Priority Data

Feb. 12, 1985 [JP] Japan ..... 60-24665

[51] Int. Cl.[4] ..... G03C 5/18; G03C 5/54; G03C 1/34; G03C 1/06

[52] U.S. Cl. ..... 430/151; 430/611; 430/617; 430/619; 430/203; 430/351; 430/353; 430/955; 430/957; 430/959

[58] Field of Search ..... 430/611, 617, 619, 203, 430/351, 353, 151, 955, 957, 959

[56] References Cited

U.S. PATENT DOCUMENTS 4,500,634 2/1985 Sakanoue et al. ..... 430/544
4,618,571 10/1986 Ichijima et al. ..... 430/505

*Primary Examiner*—Richard L. Schilling
*Assistant Examiner*—Lee C. Wright
*Attorney, Agent, or Firm*—Sughrue, Mion, Zinn, Macpeak & Seas

[57] ABSTRACT

A process of forming images by heat developing a heat developable light-sensitive material after imagewise exposure is described, comprising heating a heat developable light-sensitive material in the presence of a compound represented by general formula (I)

(I)

12 Claims, No Drawings

IMAGE FORMING PROCESS

FIELD OF THE INVENTION

This invention relates to an image forming process having a heating step and, more particularly, the invention relates to an image forming process having a heating step in the presence of a precursor for a photographic reagent.

BACKGROUND OF THE INVENTION

A photographic process using silver halide is excellent in photographic characteristics such as sensitivity and gradation control as compared with an electrophotographic process and a diazo photographic process. Hence, the photographic process is most widely used. Recently, however, a technique of simply and quickly obtaining images by changing an image forming process of a photographic light-sensitive material using silver halide from a conventional wet process by processing liquids such as developer, etc., to a dry process by heating, etc., has been developed.

Heat developable light-sensitive materials are known in the field of the art and heat developable light-sensitive materials and the processes therefor are described, for example, in *Shashin Kogaku no Kiso* (*Basis of Photographic Industry*), pages 553–555 (published by Corona Co., 1979); *Eizo Joho* (*Image Information*), page 40 (published April, 1978); *Nebletts Handbook of Photography and Reprography,* 7th Ed., pages 32–33 (published by Van Nostrand Reinhold Company); U.S. Pat. Nos. 3,152,904, 3,301,678, 3,392,020, 3,457,075, British Pat. Nos. 1,131,108, 1,167,777, and *Research Disclosure,* pages 9–15 (RD-17029), June, 1978.

For obtaining color images, various processes have been proposed. For example, regarding a process of forming color images by the coupling of the oxidation product of a developing agent and couplers, a combination of a p-phenylenediamine series reducing agent and phenolic or active methylene couplers is proposed in U.S. Pat. No. 3,531,286; p-aminophenol series reducing agents are proposed in U.S. Pat. No. 3,761,270; sulfonamidophenolic reducing agents are proposed in Belgian Pat. No. 802,519 and *Research Disclosure,* page 32, Sept. 31, 1975; and a combination of a sulfonamidophenolic reducing agent and 4-equivalent couplers is proposed in U.S. Pat. No. 4,021,240.

Also, regarding a process of forming positive color images by a light-sensitive silver dye bleaching process, useful dyes and bleaching processes are described, for example, in *Research Disclosure,* pages 30–32 (RD-14433), April, 1976, ibid., pages 14–15 (RD-15227), December, 1976, U.S. Pat. No. 4,235,957, etc.

Furthermore, image forming processes by heat development utilizing a compound which previously has a dye moiety and can release a mobile dye in porportion to or in counterproportion to the reduction reaction to the silver of the silver halide at a high temperature state is disclosed in European Patent Application (Laid Open) Nos. 76,492 and 79,056, Japanese Patent Application (OPI) Nos. 28928/83, 26008/83, etc. (the term "OPI" as used herein refers to a "published unexamined patent application open to public inspection").

Also, processes of transferring mobile dyes imagewise formed by heat development into an image receiving layer by heating and image receiving materials which are used for such processes are described in Japanese Patent Application (OPI) Nos. 58543/83 (corresponding to U.S. Pat. No. 4,500,626), 79247/83 (corresponding to U.S. Pat. No. 4,483,914), 168439/84 (corresponding to U.S. patent application Ser. No. 509,592, filed on Mar. 16, 1984), etc.

However, in such an image forming process having heatng step(s), the supply of necessary photographic reagent(s) from a developer, etc., cannot be expected and hence it is necessary that photographic reagents necessary for development are all previously incorporated into the light-sensitive materials. In this case, when the photographic reagents are incorporated into the light-sensitive materials in active form, the photographic reagents react with the other components in the photographic light-sensitive materials during the storage thereof before processing or are decomposed by the influences of heat, oxygen, etc., whereby the desired performance of the photographic reagent(s) cannot be obtained at processing.

One attempt at solving these problems involves incorporating a photographic reagent in a photographic light-sensitive material in a substantially inactive form, i.e., a precursor for the photographic reagent. When a useful photographic reagent is a dye, the spectral absorption of the dye is shifted to a short wavelength side or a long wavelength side by blocking the functional group of the dye, which gives large influences on the spectral absorption of the dye, whereby even when the dye coexists in a silver halide emulsion layer having a corresponding photosensitive spectral region, the reduction in sensitivity by a so-called filter effect does not occur. When a useful photographic reagent is an antifoggant or a development inhibitor, by blocking the active group thereof, the occurrence of desensitizing action by the adsorption of the photographic reagent onto light-sensitive silver halide or the formation of a silver salt during the storage of the light-sensitive material can be restrained and at the same time by releasing the photographic reagent at the desired time, the formation of fog can be reduced without reducing the sensitivity, the occurrence of superdevelopment fog can be inhibited, or the development can be stopped at the desired time. Also, when the useful photographic reagent is a developing agent, an auxiliary developing agent or a fogging agent, by blocking the active group or the adsorptive group, the occurrence of various photographic undesirable actions by the formation of semiquinone or oxidation products by air oxidation during the storage of the light-sensitive materials can be prevented or the formation of fogging nuclei during storage by injecting into silver halide can be prevented, which results in realizing stable processing. Furthermore, when the photographic reagent is a bleach accelerator or a blix (bleach-fix) accelerator, by blocking the active group thereof, the occurrence of the reaction with the other components contained therein during the storage of the light-sensitive material can be inhibited and by releasing the blocking group at processing, a desired performance of the reagent can be obtained at the desired time.

Various practical techniques for blocking photographic reagents are known in conventional photographic light-sensitive materials. For example, techniques utilizing a blocking group such as an acyl group, a sulfonyl group, etc., are described in Japanese Patent Publication No. 44805/72; techniques utilizing a blocking group releasing a photographic reagent by a so-called reverse Michael reaction are described in Japanese Patent Publication Nos. 17369/79, 9696/80 and 34927/80; techniques utilizing a blocking group releasing a photographic reagent with formation of quinonemethide or a quinonemethide-like compound by intramolecular electron transfer are described in Japanese Patent Publication No. 39727/79 and Japanese Patent Application (OPI) Nos. 135944/82, 135945/82 and 136640/82; techniques utilizing an intramolecular ring closing reaction are described in Japanese Patent Application (OPI) No. 53330/80; and techniques utilizing the cleavage of a 5-membered or 6-membered ring are described in Japanese Patent Application (OPI) Nos. 76541/82, 135949/82 and 179842/82.

However, these known techniques utilize hydrolysis or dehydrogenation by the action of $OH^-$ at wet development. Precursor techniques in the case of dry processing using an organic base have not yet been known.

SUMMARY OF THE INVENTION

An object of this invention is, therefore, to provide a precursor technique for a photographic reagent in an image forming process having a heating step.

Another object of this invention is to provide a compound which is stable at normal temperature and has a function of releasing a photographic reagent at heat development or heat transfer.

Still another object of this invention is to provide an image forming process having a heating step but does not cause unevenness of images even when there is unevenness of the aforesaid heat treatment temperature.

As a result of various investigations, it has now been discovered in the present invention that the above described objects can be met by a dry image forming process wherein a light-sensitive material is heated in the presence of a compound represented by general formula (I)

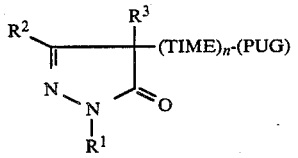

(I)

wherein $R^1$ represents a group selected from the following groups (A) to (C)

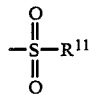

(A)

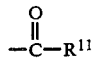

(B)

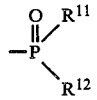

(C)

wherein $R^{11}$ and $R^{12}$, which may be the same or different, each represents a substituted or unsubstituted alkyl group, a substituted or unsubstituted cycloalkyl group, a substituted or unsubstituted alkenyl group, a substituted or unsubstituted aralkyl group, a substituted or unsubstituted aryl group, a substituted or unsubstituted heterocyclic residue, a substituted or unsubstituted alkyloxy or aryloxy group, a substituted or unsubstituted alkylthio or arylthio group, or a substituted or unsubstituted amino group; in formula (C), said $R^{11}$ and $R^{12}$ may combine with each other to form a 5-membered or 6-membered ring;

$R^2$ represents a hydrogen atom, a substituted or unsubstituted alkyl group, a substituted or unsubstituted cycloalkyl group, a substituted or unsubstituted aralkyl group, a substituted or unsubstituted aryl group, a substituted or unsubstituted heterocyclic ring residue, a substituted or unsubstituted alkyloxy or aryloxy group, a substituted or unsubstituted alkylthio or arylthio group, a substituted or unsubstituted amino group, a substituted or unsubstituted carbamoyl group, a carboxy group, an acylamino group, an acyloxy group, a sulfonylamino group, a cyano group, an alkyloxycarbonyl group, or an aryloxycarbonyl group;

$R^3$ represents a substituted or unsubstituted alkyl group, a substituted or unsubstituted cycloalkyl group, a substituted or unsubstituted aralkyl group, a substituted or unsubstituted aryl group or a substituted or unsubstituted heterocyclic ring residue, or represents a group shown by $-(TIME)_n-(PUG)$;

said $R^2$ and $R^3$ may combine with each other to form a 5-membered or 6-membered ring;

TIME represents a timing group;

PUG represents a photographically useful group;

and n represents an integer of 0 to 3.

DETAILED DESCRIPTION OF THE INVENTION

As described above, $R^1$ in general formula (I) representing the compound for use in this invention is a group shown by general group (A), (B) or (C).

The alkyl group shown by $R^{11}$ and $R^{12}$ in general formulae (A) to (C) is preferably a straight chain or branched alkyl group having 1 to 18 carbon atoms, such as practically a methyl group, an ethyl group, an n-propyl group, an n-butyl group, an n-hexyl group, an n-heptyl group, a 2-ethylhexyl group, an n-decyl group, an n-dodecyl group, etc. The cycloalkyl group is preferably 5- or 6-membered cycloalkyl group having 5 to 10 carbon atoms, such as a cyclopentyl group, a cyclohexyl group, etc. As the substituent for the substituted alkyl group or the substituted cycloalkyl group, there are a halogen atom, an alkoxy group, an aryloxy group, a cyano group, an alkylthio group, an arylthio group, a di-substituted carbamoyl group, an alkylsulfonyl group, an arylsulfonyl group, an alkyl group- or aryl group-substituted di-substituted amino group, a carboxy group, a sulfo group, an acylamino group, a sulfonylamino group, etc.

Examples of the alkenyl group shown by $R^{11}$ and $R^{12}$ are a vinyl group, an allyl group, a crotyl group, or a substituted or unsubstituted styryl group, etc. As the substituent for the substituted alkenyl group, there are the same substituent as the substituent for the substituted alkyl group, such as a chlorine atom, a bromine atom, a benzyloxy group, a methoxyethoxy group, a dodecyloxy group, a phenoxy group, a cyano group, a methylthio group, an n-decylthio group, a diethylcarbamoyl group, a piperidinocarbamoyl group, a methylsulfonyl group, a phenylsulfonyl group, a dimethylamino group, a piperidino group, a morpholino group, a carboxy group, a sulfo group, an acetylamino group, a benzoylamino group, a pivaloyl group, a methanesulfonylamino group, a p-toluenesulfonylamino group, etc. As the substituent for the substituted styryl group, there are the same substituent as the below described substituent for the substituted aryl group, such as methyl group, an ethyl group, an n-butyl group, a t-butyl group, a 2-ethylhexyl group, an n-decyl group, a phenyl group, a 1-naphthyl group, an n-dodecyl group, a methoxy group, a benzyloxy group, a methoxyethoxy group, an n-dodecyloxy group, a phenyl group, a p-chlorophenyl group, a p-methoxyphenyl group, a chlorine atom, a bromine atom, an acetylamino group, a benzoylamino group, a pivaloylamino group, a methanesulfonylamino group, a p-toluenesulfonylamino group, a hexadecylsulfonylamino group, a cyano group, a 2-cyanoethyl group, a nitro group, a methylthio group, a benzylthio group, an n-decylthio group, a methylsulfonyl group, a phenylsulfonyl group, a sulfo group, a sulfamoyl group, a diethylsulfamoyl group, a piperidinosulfonyl group, a carboxyl group, a dimethylamino group, a di-n-butylamino group, a piperidino group, a morpholino group, a butyloyloxy group, a 2-ethylhexanoyloxy group, a benzoyloxy group, an ethoxycarbonyl group, a benzyloxycarbonyl group, a diethylcarbamoyl group, a piperidinocarbamoyl group, etc.

Examples of the aralkyl group are a benzyl group, a $\beta$-phenethyl group, etc. The aralkyl group may have the substituent illustrated above as examples of the substituent for the substituted alkyl group.

The aryl group shown by $R^{11}$ and $R^{12}$ is preferably an aryl group having 6 to 18 carbon atoms, such as a phenyl group, a naphthyl group, an anthryl group, etc. As the substituent for the substituted aryl group, there are a substituted or unsubstituted alkyl group, a substituted or unsubstituted alkoxy group, a substituted or unsubstituted aryl group, a halogen atom, an acylamino group, a sulfonylamino group, a cyano group, a nitro group, an alkylthio or arylthio group, an alkylsulfonyl or arylsulfonyl group, an alkoxycarbonyloxy group, a hydroxy group, a substituted or unsubstituted carbamoyl group, a substituted or unsubstituted sulfamoyl group, an alkyl- or aryl-substituted di-substituted amino group, a carboxy group, a sulfo group, an alkyloxycarbonyl group, an aryloxycarbonyl group, etc.

The heterocyclic ring residue is preferably a 5- or 6-membered heterocyclic ring containing an oxygen atom, a nitrogen atom or a sulfur atom as the hetero atom, such as a pyridyl group, a furyl group, a thienyl group, a pyrrole group, an indolyl group, etc. The heterocyclic ring residue may have the substituent shown above as examples of the substituent for the substituted aryl group.

Preferred examples of the alkyloxy or aryloxy group and the alkylthio or arylthio group shown by $R^{11}$ and $R^{12}$ are shown by the following formulae (D) and (E), respectively:

$$-OR^{13} \quad (D)$$

$$-SR^{14} \quad (E)$$

wherein $R^{13}$ and $R^{14}$ preferably represent a substituted or unsubstituted alkyl group or a substituted or unsubstituted aryl group illustrated above about $R^{11}$ and $R^{12}$.

Examples of the alkyl group, the cycloalkyl group, the aralkyl group, the aryl group, the heterocyclic ring residue, the alkyloxy or aryloxy group and the alkylthio or arylthio group in the groups shown by $R^2$ and $R^3$ in general formula (I) described above are the groups as illustrated above in regard to $R^{11}$ and $R^{12}$.

Also, examples of the substituted amino group shown by $R^2$ and $R^3$ are a butylamino group, a dimethylamino group, an anilino group, etc. Examples of the substituted carbamoyl group are an ethylcarbamoyl group, a diethylcarbamoyl group, a piperidinocarbamoyl group, etc. Examples of the acylamino group are an acetylamino group, a benzoylamino group, a pivaloylamino group, etc. Examples of the acyloxy group are a butyroyloxy group, a 2-ethylhexanoyloxy group, a benzoyloxy group, etc. Examples of the sulfonylamino groups are a methanesulfonylamino group, a toluenesulfonylamino group, a hexadecylsulfonylamino group, etc. Examples of the alkyloxycarbonyl group are an ethoxycarbonyl group, an isopropoxycarbonyl group, a benzyloxycarbonyl group, etc.

TIME in general formula (I) above represents a timing group and specific examples thereof are groups shown by $$-\overset{\overset{\displaystyle O}{\|}}{C}O-(PUG)$$

described in Japanese Patent Publication No. 9696/80, Japanese Patent Application (OPI) Nos. 1139/83 and 1140/83 and groups shown by $-OCH_2-(PUG)$ described in Japanese Patent Application (OPI) No. 93442/84.

The photographically useful group (PUG) which is released from the precursor compound in this invention includes antifoggants, development inhibitors, developing agents, developing accelerators, electron donors, fogging agents, nucleating agents, silver halide solvents, bleach accelerators, blix (bleach-fix) accelerators, fix accelerators, dyes, coloring agents for color diffusion transfer process, couplers, melting point depressants for heat-sensitive materials, coupling inhibitors for diazo heat photography, etc.

Specific examples of the antifoggant and development inhibitor are nitrogen-containing heterocyclic compounds having a mercapto group. Examples of the developing agent and development accelerator are hydroquinones, catechols, aminophenols, p-phenylenediamines, pyrazolidones, ascorbic acids, etc. Examples of the electron donors, fogging agents and nucleating agents are $\alpha$-hydroxyketones, $\alpha$-sulfonamidoketones, hydrazines, hydrazides, tetrazolium salts, aldehydes, acetylenes, quaternary salts, ylides, etc. Examples of the silver halide solvent are thioethers, rhodanines, hypo, methylenebissulfones, etc. Examples of the bleach accelerators and blix (bleach-fix) accelerators are aminoethanethiols, sulfoethanethiols, aminoethanethiocarbamates, etc. Examples of the fix accelerator are hypo, etc. Also, examples of the dye are azo dyes, azomethine dyes, anthraquinone dyes, indophenol dyes, etc.

The proper heating temperature for the light-sensitive materials in this invention is from about 50° C. to about 250° C., in particular 60° C. to 180° C.

In the above described photographically useful groups a development inhibitor can exhibit a particularly remarkable effect by blocking it in the form of general formula (I) described above and in these groups the development inhibitors represented by the following general formula (II) show particularly remarkable effect.

(II)

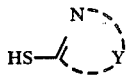

wherein Y represents an atomic group necessary for forming a 5-membered or 6-membered heterocyclic ring (containing preferably a sulfur atom, a nitrogen atom or an oxygen atom in the ring).

In general formula (II) a blocking group is bonded to the development inhibitor at the sulfur or nitrogen atom.

Specific examples of the preferred development inhibitors represented by general formula (II) are illustrated below.

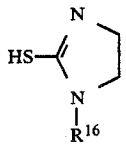

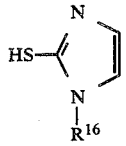

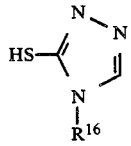

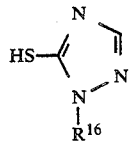

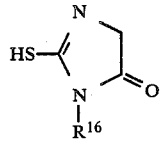

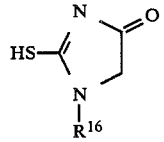

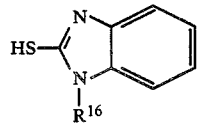

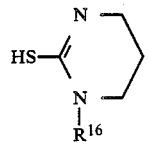

-continued

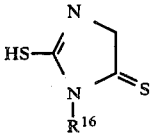

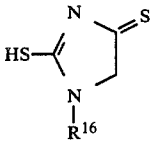

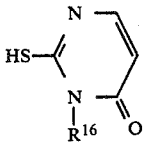

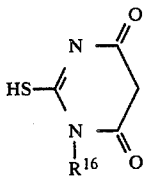

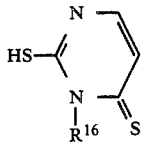

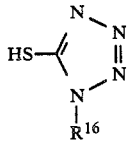

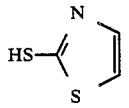

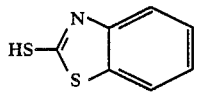

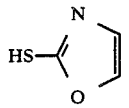

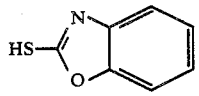

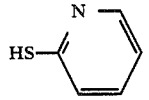

-continued

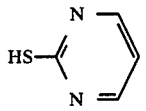

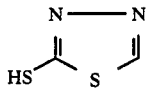

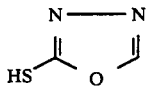

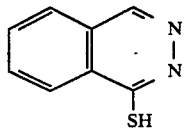

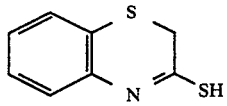

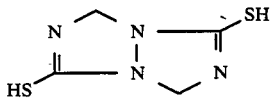

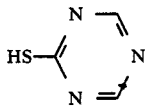

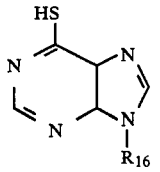

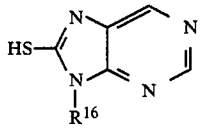

In the above formulae, $R^{16}$ represents a hydrogen atom, an alkyl group, an aryl group, a cycloalkyl group, an alkenyl group, or an aralkyl group and the above described groups may have a proper substituent such as, typically, the group illustrated above in regard to $R^{11}$. Also, the carbon atom(s) forming the aforesaid ring structure may have a substituent such as, typically, the aforesaid benzene ring or naphthalene ring, such as a methyl group, an ethyl group, an n-butyl group, a t-butyl group, a 2-ethylhexyl group, an n-decyl group, a phenyl group, a 1-naphthyl group, an n-dodecyl group, a methoxy group, a benzyloxy group, a methoxyethoxy group, an n-dodecyloxy group, a phenyl group, a p-chlorophenyl group, a p-methoxyphenyl group, a chlorine atom, a bromine atom, an acetylamino group, a benzoylamino group, a pivaloylamino group, a methanesulfonylamino group, a toluenesulfonylamino group, a hexadecylsulfonylamino group, a cyano group, a 2-cyanoethyl group, a nitro group, a methylthio group, a benzylthio group, an n-decylthio group, a methylsulfonyl group, a phenylsulfonyl group, a sulfo group, a sulfamoyl group, a diethylsulfamoyl group, a piperidinosulfonyl group, a carboxyl group, a dimethylamino group, a di-n-butylamino group, a piperidino group, a morpholino group, a butyloyloxy group, a 2-ethylhexanoyloxy group, a benzoyloxy group, an ethoxycarbonyl group, a benzyloxycarbonyl group, a diethylcarbamoyl group, a piperidinocarbamoyl group, a hydroxyl group, etc.

It is known that the nitrogen-containing heterocyclic compound having a mercapto group represented by general formula (II) above has a development inhibiting effect in silver halide photographic light-sensitive materials and also it is known about heat developable light-sensitive materials as described, for example, in Japanese Patent Application No. 176351/84. However, if the compound shown by general formula (II) exists in a silver halide emulsion layer from the first, the development is restrained from the beginning of development, whereby the image density is lowered and the sensitivity is also lowered. On the other hand, since the compound for use in this invention represented by general formula (I) gradually releases the development inhibitor of general formula (II) upon heat development, the development can be stopped without reducing the density of images formed.

Also, by incorporating the compound for use in this invention shown by general formula (I) in the form of blocking the development inhibitor shown by general formula (II), a heat developable light-sensitive material or a dye fixing material having a compensating faculty for temperature unevenness of the heat processing temperature can be obtained. Since the heat development is usually performed at a temperature of higher than 100° C., the occurrence of delicate temperature unevenness is unavoidable. Furthermore, the image-attaining density is higher at a higher temperature portion and is lower at a lower temperature portion, whereby the unevenness of images, in particular the unevenness of fog density at the non-imaged portions, occurs on the whole. Also, it sometimes happens that the development proceeds at the heat transfer of a diffusible dye and in this case if there is unevenness in the heating temperature, the unevenness sometimes occurs in the transferred image density. However, when the compound for use in this invention represented by general formula (I) is incorporated, the released amount of the development inhibitor shown by general formula (II) is larger at higher temperature portions and the image-attaining density is restrained, whereby it has been succeeded in reducing the occurrence of the unevenness of image density on the whole.

It is considered that in the case of the compound for use in this invention represented by general formula (I), a protective group at the 1-position of the pyrazolone ring is eliminated by the action of the nucleophilic reagent upon heat development or heat transfer to form an anion shown by general formula (III) described below and further to release PUG or the dissociation product thereof by an intramolecular electron transfer.

The decomposition scheme of the compound shown by general formula (I) is shown below.

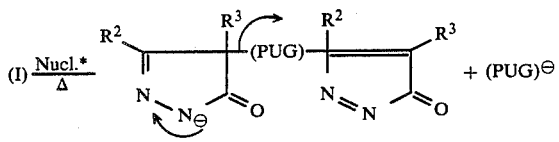

(III)

*Nucleophilic reagent

For eliminating the protective group at the 1-position of the pyrazolone ring, it is generally necessary to give an attack of a nucleophilic reagent. The content of the nucleophilic reagent has not yet been clarified but various terminal residues of amino acids which are elements for constituting gelatin forming a binder (e.g., $-NH_2$, $-OH$, $-CO_2H$, $-SH$,

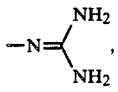

etc.) can be used.

Also, when a base or a base precursor is used as the development accelerator, the base itself or the base formed from the precursor fuctions as a nucleophilic reagent at heating to accelerate the release of PUG. Therefore, the use of the base or the base precursor together with the compound of this invention represented by general formula (I) is particularly advantageous.

While it may be expected that the reaction of the compound of this invention represented by general formula (I) and a nucleophilic reagent would occur in a solution, it is an unexpected discovery that the reaction also effectively occurs in a dry layer in a short period of time upon heating.

Specific examples of the compound for use in this invention represented by general formula (I) above are illustrated below but the invention is not limited to them.

(1)

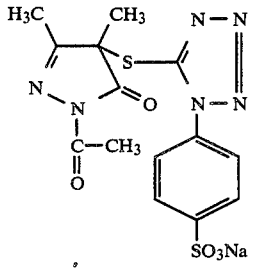

(2)

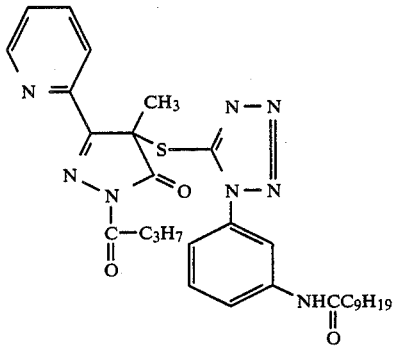

(3)

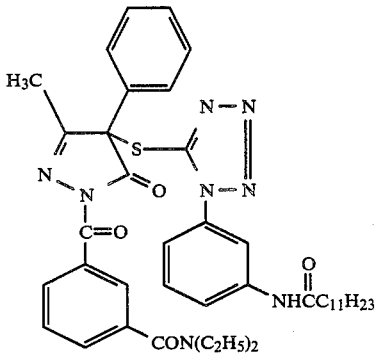

(4)

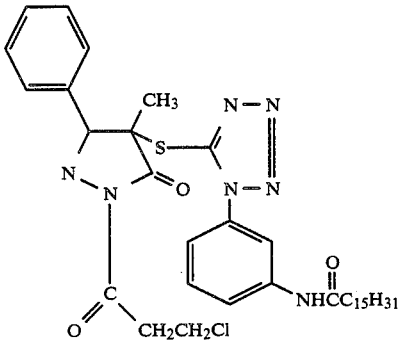

-continued
(5)
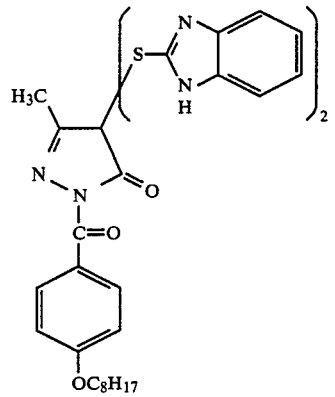
(6)
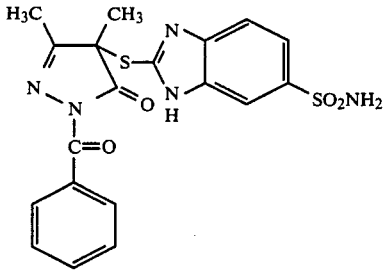
(7)
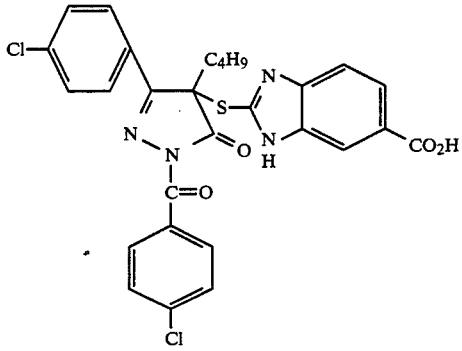
(8)
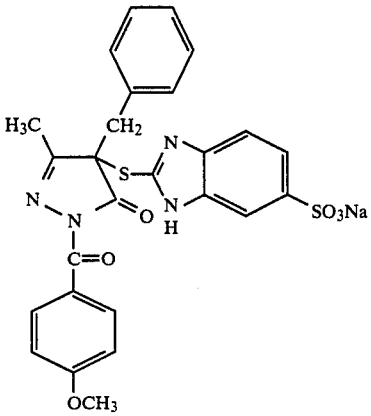
(9)
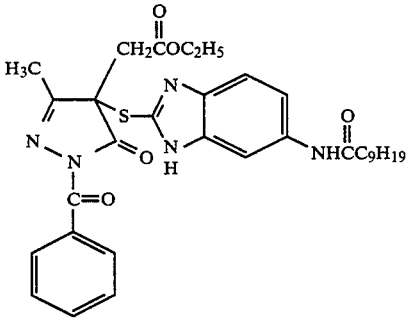
(10)
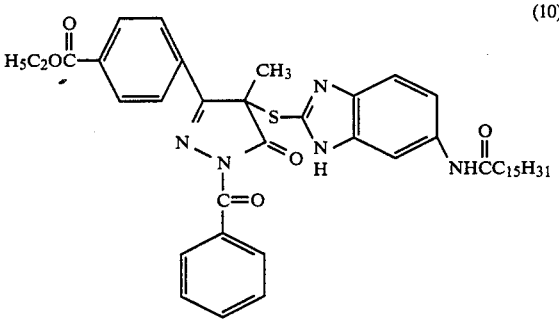
(11)
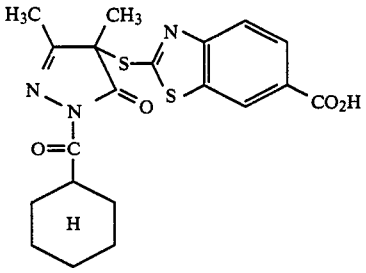
(12)
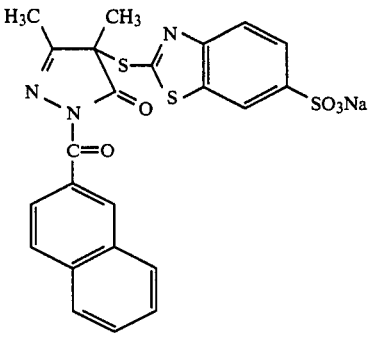

-continued
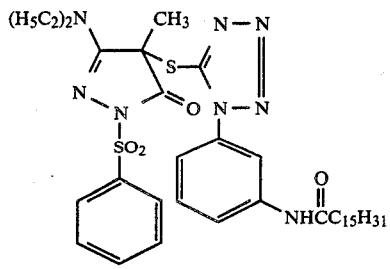
(13)
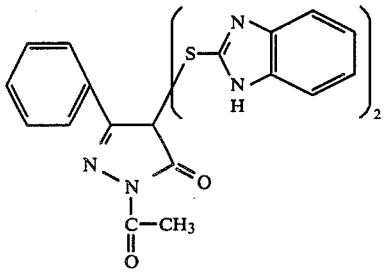
(14)
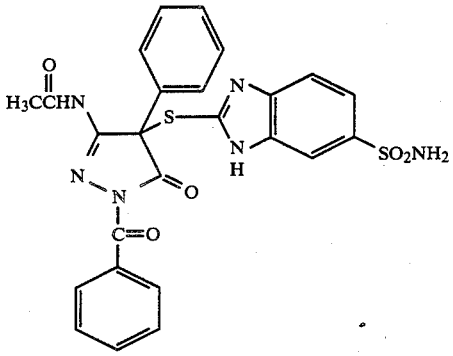
(15)
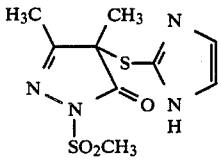
(16)
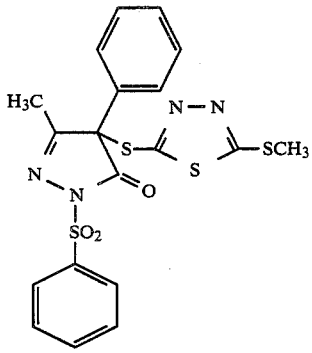
(17)
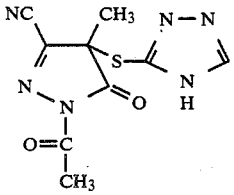
(18)
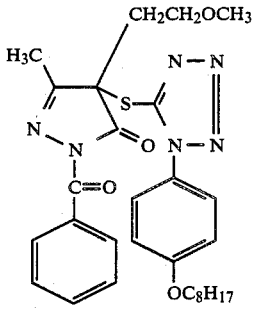
(19)
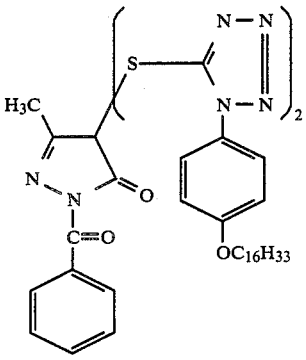
(20)

-continued
(21)
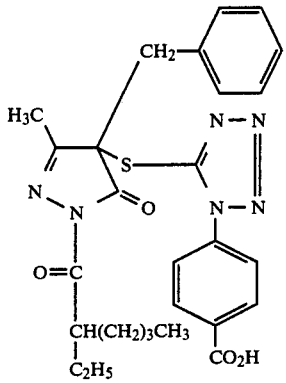
(22)
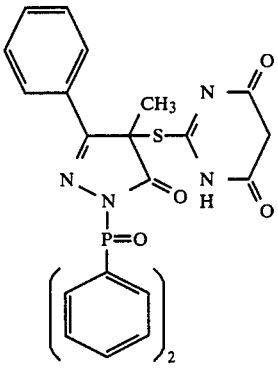
(23)
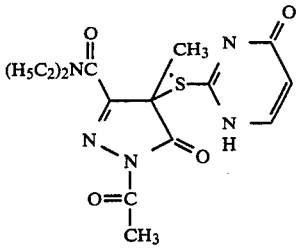
(24)
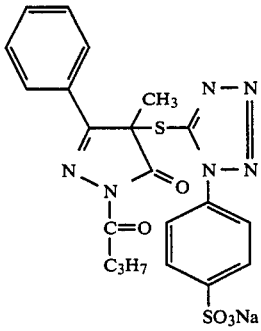
(25)
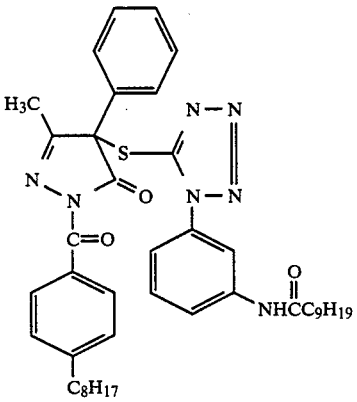
(26)
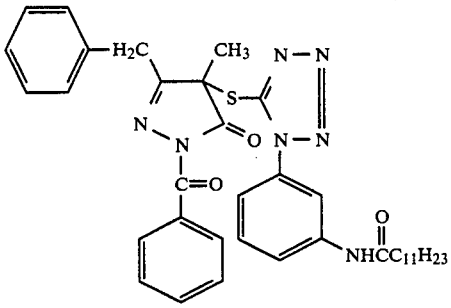
(27)
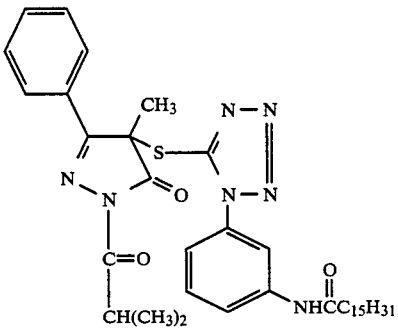
(28)
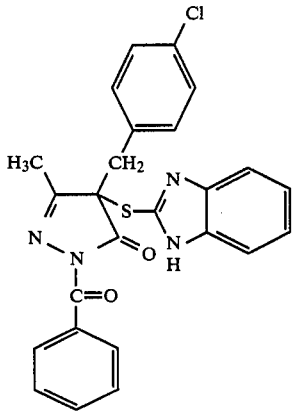

-continued
(29)
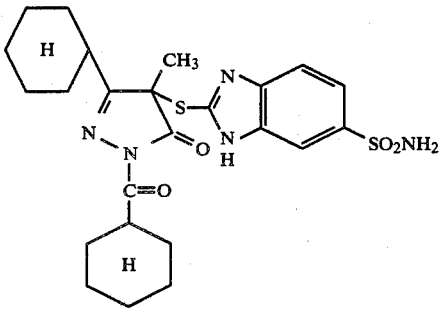
(30)
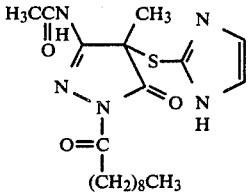
(31)
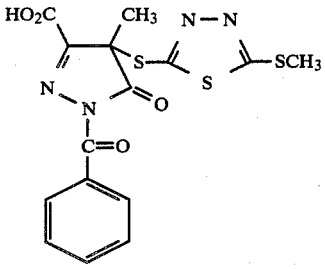
(32)
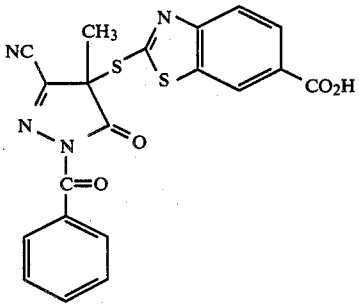
(33)
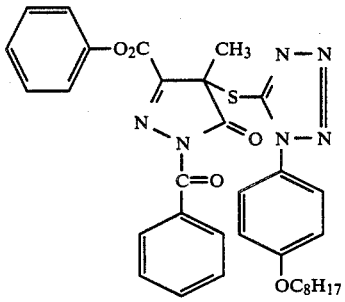
(34)
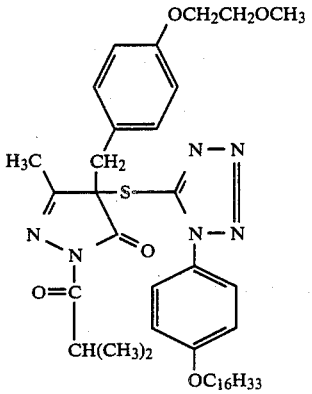
(35)
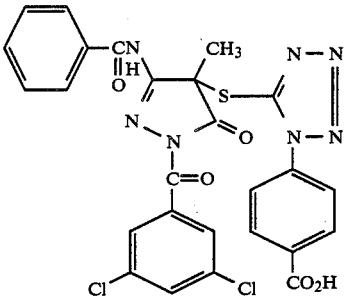
(36)
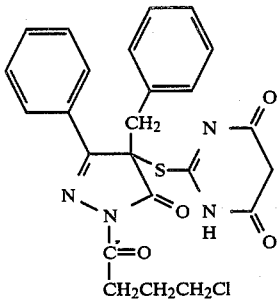
(37)
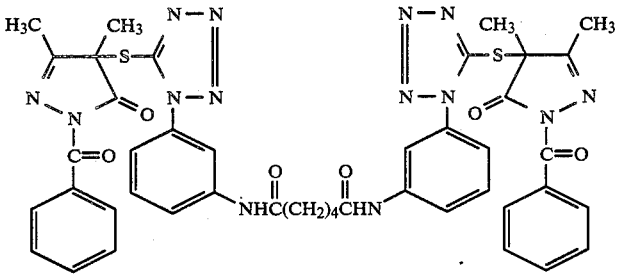

-continued
(38)
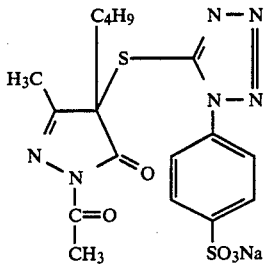
(39)
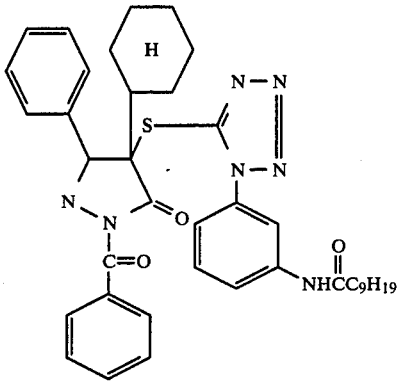
(40)
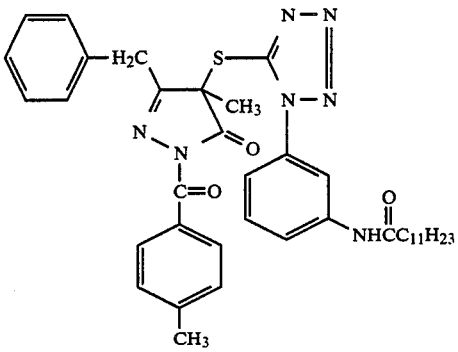
(41)
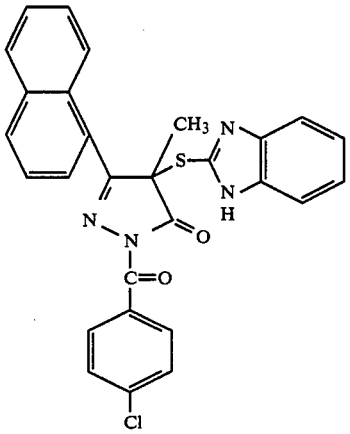
(42)
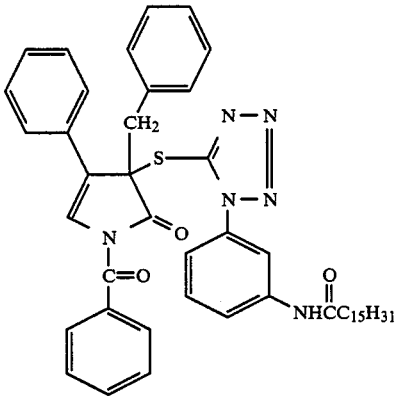
(43)
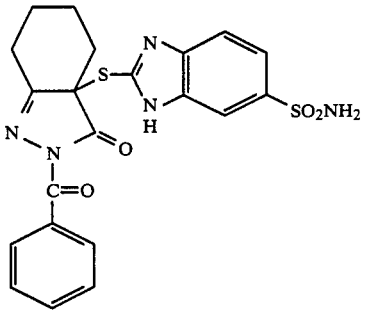
(44)
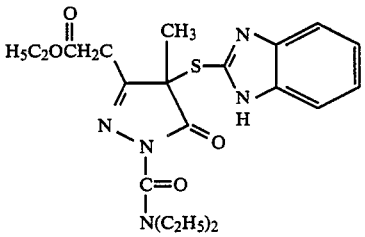

-continued
(45)
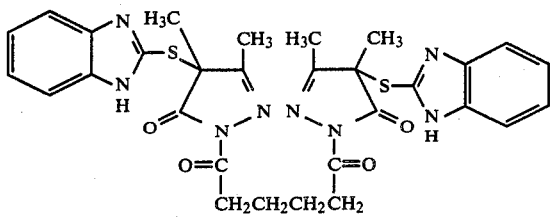
(46)
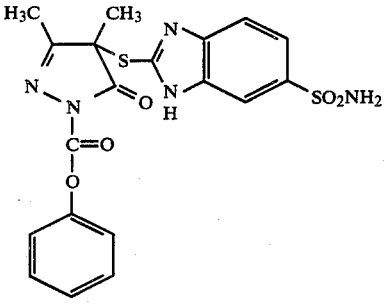
(47)
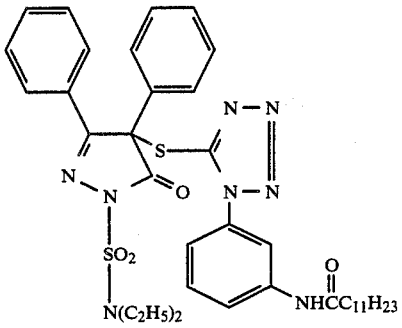
(48)
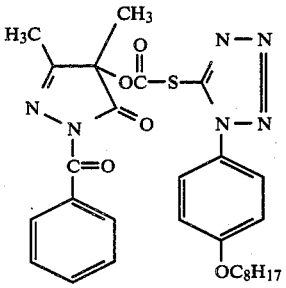
(49)
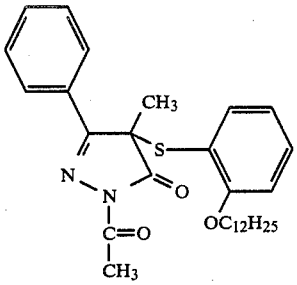
(50)
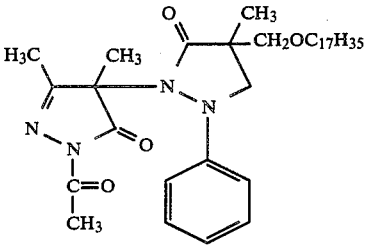
(51)
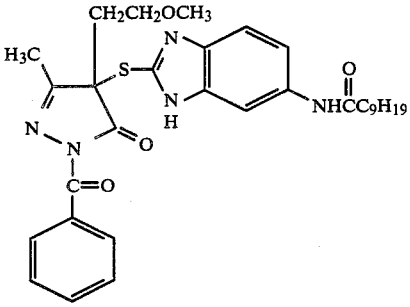
(52)
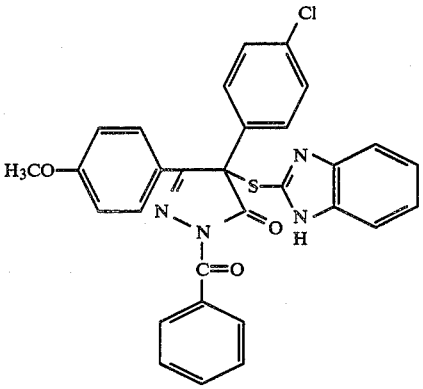
(53)
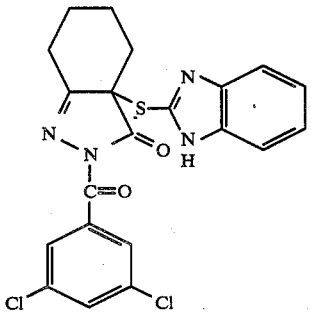

-continued

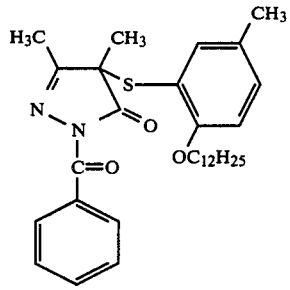

(54)

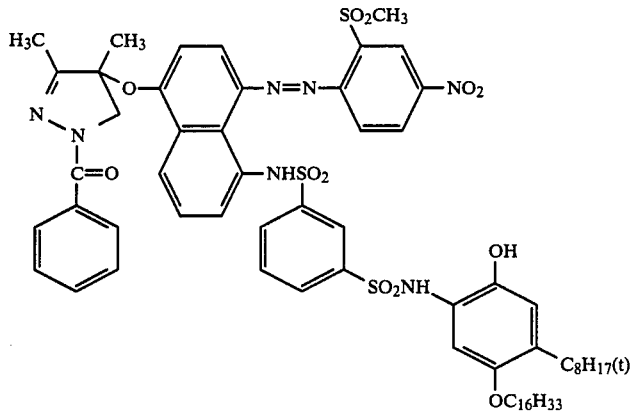

(55)

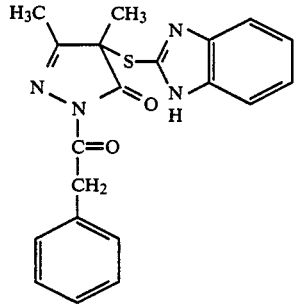

(56)

Synthesis examples for the compounds of this invention represented by general formula (I) are described below.

The aforesaid compounds for use in this invention can be synthesized from acetoacetic acid esters or α-mono-substituted acetoacetic acid esters by the following synthesis route.

Also, compounds a, b and c in the following synthesis route can be prepared according to the methods described in articles 1 to 4 described below.

The synthesis route of the compounds shown in general formula (I) is shown below.

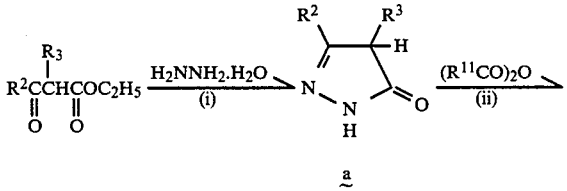

a

-continued

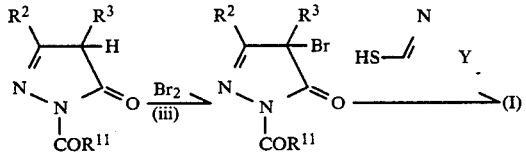

b c

In addition, in the above described synthesis route the order of the acylation step (ii) and the halogenation step (iii) may be reversed.

Also, in the case of the condensation reaction step (iv), an organic base such as triethylamine, etc., can be preferably used as a condensing agent.

The synthesis for compounds a, b and c and the derivatives thereof from acetoacetic acid ester derivatives are performed according to the methods described in the following articles.

1. *J. Amer. Chem. Soc.*, 65, 1495–1502 (1943)
2. *J. Amer. Chem. Soc.*, 80, 599–604 (1958)
3. *J. Amer. Chem. Soc.*, 80, 5796–5798 (1958)
4. *J. Org. Chem.*, 31, 2867–2873 (1966)

SYNTHESIS EXAMPLE 1

Synthesis of Compound (14)

To about 120 ml of an acetonitrile suspension containing 15 g (0.1 mol) of 2-mercaptobenzimidazole and 15.3 ml (0.11 mol) of triethylamine was gradually added 12.7 g (0.04 mol) of 1-acetyl-3-phenyl-4,4-dibromo-2-pyrazolin-5-one prepared by the method described in *J. Amer. Chem. Soc.*, 80, 5796–5798 (1958) with stirring. After the addition, an oily material deposited. After allowing the reaction mixture to stand about 24 hours, the crystallized reaction product thus formed was collected by filtration and washed with about 50 ml of acetonitrile. The crystals thus obtained were recrystallized from methanol to provide 2.5 g (0.005 mol) of Compound (14) having a melting point of higher than 300° C.

SYNTHESIS EXAMPLE 2

Synthesis of Compound (6)

Synthesis of 3,4-Dimethyl-2-pyrazolin-5-one

After heating 100 ml of an ethylene glycol solution containing 47.5 g (0.33 mol) of α-methyl-ethylacetoacetate to 50° to 60° C. on a warm water bath with stirring, 27 g (0.43 mol) of hydrazine 80% hydrate was added dropwise to the solution. During the addition, crystals deposited. After the addition of hydrazine, the reaction was further performed for 30 minutes at 80° to 90° C. The reaction mixture was added to 1 liter of ice water with stirring and the crystals thus deposited were collected by filtration and washed with water to provide 31.1 g (0.28 mol) of the desired compound at a yield of 85%.

Synthesis of 1-Benzoyl-3,4-dimethyl-4-bromo-2-pyrazolin-5-one

To a suspension containing 11.2 g (0.1 mol) of 3,4-dimethyl-2-pyrazolin-5-one obtained in the above step and 30 ml of nitromethane, 5.2 ml (0.1 mol) of bromine was added dropwise. Thereafter, the reaction mixture was heated to 50° to 60° C. for 1 hour and then to 90° C. for 1 hour. After allowing the reaction mixture to stand about 24 hours, about 1 liter of water was added to the reaction mixture to form deposits, which were collected and extracted with about 500 ml of ethyl acetate. The ethyl acetate extract was separated and concentrated to dryness under reduced pressure to provide 15 g of an oily material.

To 15 g of the oily material thus formed was added 15 g (0.066 mol) of benzoic anhydride and a reaction was performed for 10 hours at 80° to 90° C. with stirring. After the reaction was over, the reaction mixture was allowed to stand about 24 hours and excessive benzoic anhydride thus deposited was filtered away. The filtrate thus formed was purified by column chromatography (silica gel-n-hexane/chloroform (v/v=1/1)) to provide 6.2 g (0.02 mol) of the above described compound with a yield of 20%.

Synthesis of Compound (6)

To a suspension of 3.9 g (0.017 mol) of 2-mercapto-5-sulfamoylbenzimidazole, 2.9 ml (0.02 mol) of triethylamine, and 30 ml of acetonitrile, 20 ml of an acetonitrile solution containing 6.0 g (0.020 mol) of 1-benzoyl-3,4-dimethyl-4-bromo-2-pyrazolin-5-one obtained above was added dropwise with stirring and, thereafter, the mixture was stirred for 30 minutes at room temperature. After the reaction was over, insoluble matters were filtered away from the reaction mixture thus obtained and the filtrate was concentrated to dryness under reduced pressure to provide an oily material. The oily material was purified by column chromatography (silica gel-chloroform/acetonitrile (v/v=½)) to provide 2.5 g of Compound (6) as a glassy product. The yield was 33%.

SYNTHESIS EXAMPLE 3

Synthesis of Compound (1)

Synthesis of 1-Acetyl-3,4-dimethyl-4-bromo-2-pyrazolin-5-one

To a suspension of 40 g (0.36 mol) of 3,4-dimethyl-2-pyrazolin-5-one prepared by Synthesis Example 2 and 200 ml of acetic acid, 57 g (0.36 mol) of bromine was added dropwise with stirring. After the dropwise addition, the reaction mixture was heated to 60° to 70° C. for 2 hours. After allowing the reaction mixture to stand about 24 hours, the reaction mixture was added to 1 liter of water to form deposits, which were extracted with 1 liter of ethyl acetate, washed with water, and separated. Thereafter, the ethyl acetate extract was concentrated to dryness under reduced pressure to provide 50 g of an oily material. The oily material thus obtained was purified by column chromatography (silica gel-chloroform/n-hexane (v/v=2/1)) to provide 33 g (0.14 mol) of the oily desired compound. The yield was 39%.

Synthesis of Compound (1)

To a suspension of 200 ml of acetonitrile containing 22 g (0.078 mol) of sodium 5-mercapto-1-(4-sulfonyl)tetrazole prepared by the method described in British Pat. No. 1,275,701 and 13 ml (0.093 mol) of triethylamine, and 50 ml of water, 50 ml of acetonitrile containing 22 g of 1-acetyl-3,4-dimethyl-4-bromo-2-pyrazolin-5-one was added dropwise for 20 minutes with stirring. After the dropwise addition, a reaction was performed for further 2 hours. This reaction mixture was added to 1 liter of water to form deposits, which were extracted 3 times with 3 liters of ethyl acetate, and separated. Thereafter, the ethyl acetate extract was concentrated to dryness under reduced pressure to provide 30 g of an oily material. The oily material was purified by column chromatography (silica gel-chloroform/methanol (v/v=2/1)) to provide 10 g (0.023 mol) of Compound (1) as oily product. The yield was 29%.

SYNTHESIS EXAMPLE 4

Synthesis of Compound (12)

Synthesis of 1-(2-Naphthoyl)-3,4-dimethyl-2-pyrazolin-5-one

To a suspension of 22 g (0.2 mol) of 3,4-dimethyl-2-pyrazoline-5-one prepared by Synthesis Example 2 and 200 ml of pyridine, 57.2 g (0.2 mol) of 2-naphthoylchloride was added dropwise at 10° C. or less for 1 hour. After the dropwise addition, a reaction was performed for further 1 hour. This reaction mixture was added to 2 liters of water containing 220 ml of 36% hydrochloric acid to form deposits, which were extracted with 1 liter of ethyl acetate, washed with water, and separated. Thereafter, the ethyl acetate extract was concentrated to dryness under reduced pressure to provide 30 g of an oily material. Then, 100 ml of acetonitrile was added to the oily material. After heating and dissolving the oily material, it was allowed to stand about 24 hours, then a colorless crystal was separated out. This crystal was filtered out and washed with acetonitrile. The thus-obtained crystal was used in the next step without further purification. The yield amount was 20 g (0.075 mol) with the yield of 38%.

Synthesis of 1-(2-Naphthoyl)-3,4-dimethyl-4-bromo-2-pyrazolin-5-one

To a suspension of 20 g (0.075 mol) of 1-(2-naphthoyl)-3,4-dimethyl-2-pyrazolin-5-one and 200 ml of acetic acid, 12 g (0.075 mol) of bromine was added dropwise with stirring. After the dropwise addition, the reaction mixture was heated to 80° to 90° C. for 2 hours. After allowing the reaction mixture to stand about 24 hours, the reaction mixture was added to 1 liter of water to form an oily material, which was extracted with 1 liter of ethyl acetate, washed with water, and separated. Thereafter, the ethyl acetate extract was concentrated to dryness under reduced pressure to provide 20 g of an oily material. The oily material thus formed was purified by column chromatography (silica gel-chloroform/n-hexane (v/v=1/1)) to provide 15 g (0.043 mol) of the oily desired compound. The yield was 57%.

Synthesis of Compound (12)

To a suspension of 200 ml of acetonitrile containing 10 g (0.037 mol) of sodium 2-mercaptobenzothiazole-6-sulfonate prepared by the method described in U.S. Pat. No. 2,593,800 and 6.3 ml (0.045 mol) of trimethylamine, and 50 ml of water, 50 ml of acetonitrile containing 15 g (0.043 mol) of 1-(2-naphthoyl)-3,4-dimethyl-4-bromo-2-pyrazolin-5-one was added dropwise for 15 minutes with stirring. After the dropwise addition, a reaction was performed for further 2 hours. The reaction mixture was added to 1 liter of water to form deposits, which were extracted 3 times with 3 liters of ethyl acetate, and separated. Thereafter, the ethyl acetate extract was concentrated to dryness under reduced pressure to provide 15 g of an oily material. The oily material thus obtained was purified by column chromatography (silica gel-chloroform/methanol (v/v=2/1)) to provide Compound (12) as the oily product. The yield was 45%

The amount of the compound for use in this invention depends upon the kind of the compound and the system employed but is generally less than 50% by weight, preferably less than 30% by weight, based on the weight of the coating. The optimum amount of the compound is largely influenced by the structure of the development inhibitor of formula (II) to be released. The development inhibitors of general formula (II) illustrated above include a compound which conversely accelerates the development when the amount is small but inhibits the development when the amount thereof is increased. Accordingly, when the compound for use in this invention shown by general formula (I) which releases the compound of formula (II) is added, it is particularly useful because the initial development is accelerated and, thereafter, the development is inhibited in the latter half of the development.

The compound for use in this invention shown by formula (I) can be incorporated in a binder as a solution in a water-soluble organic solvent (e.g., methanol, ethanol, acetone, dimethylformamide, etc.) or a mixture of the organic solvent and water.

Moreover, the hydrophobic compound for use in this invention can be incorporated in a binder as fine droplets in an oil protect method.

The compounds for use in this invention shown by formula (I) can be used solely or as a combination of two or more of them. Furthermore, the compound(s) can be used together with another development stopping agent or development stopping technique. As such development stopping techniques, there are a method of using the thermal decomposition of aldoxime ester described in Japanese Patent Application Nos. 216928/83 (corresponding to U.S. patent application Ser. No. 672,643, filed on Nov. 19, 1984) and 48305/84 (corresponding to U.S. patent application Ser. No. 711,885, filed on Mar. 14, 1985), a method of utilizing a Lossen rearrangement described in Japanese Patent Application No. 85834/84 (corresponding to U.S. patent application Ser. No. 727,718, filed on Apr. 26, 1985), and a method of using a carboxylic acid ester described in Japanese Patent Application No. 85836/84 (corresponding to U.S. patent applicaton Ser. No. 727,928, filed on Apr. 26, 1985).

In this invention it is preferred to use an image forming process having a heating step, which is used for a so-called heat developable light-sensitive material (e.g., those described in the above described conventional techniques). That is, the compound of general formula (I) may be incorporated in any layer(s) (e.g., light-sensitive layer, interlayer, protective layer, etc.) existing on a support for constituting a heat developable light-sensitive material or, when an image receiving layer is formed on other support than the support for a heat developable light-sensitive material, may be incorporated in any layer on the support for the image receiving material.

The heat developable light-sensitive material for this invention is most preferred to use silver halides as light-sensitive elements.

The silver halide which can be used in this invention may be silver chloride, silver bromide, silver iodide, silver chlorobromide, silver chloroiodide, silver iodobromide or silver chloroiodobromide, the silver halide may have a uniform silver composition in the silver halide grains or may have a structure that the surface composition differs from the inside composition (see Japanese Patent Application (OPI) Nos. 154232/82, 108533/83, 48755/84 and 52237/84, U.S. Pat. No. 4,433,048 and European Pat. No. 100,984). Also, tabular silver halide grains having a thickenss of grains of less than 0.5 μm, a diameter of at least about 0.6 μm, and a mean aspect ratio of higher than 5 (see U.S. Pat. Nos. 4,414,310 and 4,435,499, West German Patent Application (OLS) No. 3,241,646A1) or a monodispersed silver halide emulsion having an almost uniform grain size distribution (see Japanese Patent Application (OPI) Nos. 178235/82, 100846/83 and 14829/83, PCT Application (OPI) No. 02338A1/83 and European Patent Nos. 64,412A3 and 83,377A1, etc.) can be used in this invention. Two or more kinds of silver halides having different crystal habit, silver halide composition, grain size, grain size distribution, etc., may be used together. A mixture of two or more kinds of monodispersed silver halide emulsions having different grain size can be used for controlling gradation.

It is preferred that the mean grain size of the silver halide for use in this invention is from 0.001 μm to 10 μm, particularly from 0.001 μm to 5 μm.

The silver halide emulsion for use in this invention may be prepared by an acid method, a neutralization method, or an ammonia method. Also, as a reaction system of a soluble silver salt and a soluble halide salt, a single jet method, a double jet method or a combination thereof may be used. In addition, a back mixing method of forming silver halide grains in the presence of excessive silver ion or a controlled double jet method of maintaining a constant pAg can be employed. Furthermore, for increasing the growth of silver halide grains, the concentration, the addition amount or the addition rate of silver salt and halide salts, may be increased (see Japenese Patent Application (OPI) Nos. 142239/80 and 158124/80, U.S. Pat. No. 3,650,757, etc.).

Furthermore, epitaxial junction type silver halide grains can be used in this invention (see Japanese Patent Application (OPI) No. 16124/81 and U.S. Pat. No. 4,094,684).

When silver halide is used solely without using an organic silver salt oxidizing agent in this invention, it is preferred to use silver chloroiodide, silver iodobromide or silver chloroiodobromide showing the X-ray patterns of silver iodide crystal.

As such a silver salt, for example, silver iodobromide having the above described characteristics can be obtained by adding a solution of silver nitrate to a solution of potassium bromide to form silver bromide grains and further adding potassium iodide to the mixture.

In the step of forming silver halide grains for use in this invention, ammonia, an organic thioether derivative described in Japanese Patent Publication No. 11386/72, or a sulfur-containing compound described in Japanese Patent Application (OPI) No. 144319/78 can be used.

The silver halide grains may be formed or physically ripened in the presence of a cadmium salt, a zinc salt, a lead salt, a thallium salt, etc.

Furthermore, for improving a high intensity reciprocity failure or a low intensity reciprocity failure, a water-soluble iridium salt such as iridium (III or IV) chloride, ammonium hexachloroiridate, etc., or a water-soluble rhdoium salt such as rhodium chloride, etc., may be employed.

After the formation of precipitates or physical ripening, soluble salts may be removed from the silver halide emulsion. For this purpose, a noodle washing method or a flocculation method can be used.

The silver halide emulsion may be used as primitive emulsion but is usually chemically sensitized by, for example, a sulfur sensitization method, a reduction sensitization method, a noble metal sensitization method, etc., which are used for conventional photographic light-sensitive materials. These sensitization methods can be used individually or as a combination thereof. Moreover, the chemical sensitization can be performed in the presence of a nitrogen-containing heterocyclic compound as disclosed in Japanese Patent Application (OPI) Nos. 126526/83 and 215644/83.

The silver halide emulsion for use in this invention may be of a surface latent image type of mainly forming a latent image on the surface of silver halide grains or of an internal latent image type of mainly forming a latent image in the inside of silver halide grains. A direct reversal silver halide emulsion composed of a combination of an internal latent image type silver halide emulsion and a nucleating agent can be used. Internal latent image type silver halide emulsions suitable for the direct reversal emulsions are described in U.S. Pat. Nos. 2,592,250, 3,761,276, Japanese Patent Publication No. 3534/83 and Japanese Patent Application (OPI) No. 136641/82. Also, the nucleating agents suitable for the above described combination are described in U.S. Pat. Nos. 3,227,552, 4,245,037, 4,255,511, 4,266,031, 4,276,364 and West German Patent Application (OLS) No. 2,635,316.

The coating amount (coverage) of the light-sensitive silver halide for use in this invention is generally in the range of 1 mg/m$^2$ to 10 g/m$^2$ calculated as silver.

In this invention an organic metal salt which is relatively stable to light can be used as an oxidizing agent together with the light-sensitive silver halide. In this case, it is necessary that the light-sensitive silver halide and the organic metal salt are in contact with each other or adjacent to each other. Of the organic metal salts, organic silver salts are preferably used. It is considered that when such an organic metal salt is used with light-sensitive silver halide, the organic metal salt (oxidizing agent) takes part in the redox reaction with the latent images of the silver halide as catalyst in the case of heating the heat developable light-sensitive material to temperatures of higher than 80° C., preferably higher than 100° C.

As an organic compound capable of forming the above described organic silver salt oxidizing agent, there are an aliphatic or aromatic carboxylic acid, a thiocarbonyl group-containing compound having a mercapto group or an $\alpha$-hydrogen, and an imino group-containing compound.

Specific examples of the silver salt of an aliphatic carboxylic acid are the silver salts derived from behenic acid, stearic acid, oleic acid, lauric acid, capric acid, myristic acid, palmitic acid, maleic acid, fumaric acid, tartaric acid, furilic acid, linolic acid, linolenic acid, oleic acid, adipic acid, sebacic acid, succinic acid, acetic acid, butyric acid, or camphoric acid. Also, silver salts derived from halogen atom or hydroxyl group substituted product of these aliphatic acid, or silver salts derived from aliphatic carboxylic acid having thioether are used.

As the silver salts of aromatic carboxylic acids and other carboxy group-containing compounds, there are the silver salts derived from benzoic acid, 3,5-dihydroxybenzoic acid, o-, m- or p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, or 3-carboxymethyl-4-methyl-4-thiazoline-2-thione.

Also, as the silver salts of mercapto group-or thiocarbonyl group-containing compounds, there are the silver salts derived from 3-mercapto-4-phenyl-1,2,4-triazole, 2-mercaptobenzimidazole 2-mercapto-5-aminothiadiazole, 2-mercaptobenzothiazole, S-alkylthioglycolic acid (carbon atoms of the alkyl group being 12 to 22), dithiocarboxylic acids (e.g., dithioacetic acid, etc.), thioamides (e.g., thiostearamide, etc.), 5-carboxy-1-methyl-2-phenyl-4-thiopyridine, mercaptotriazine, 2-mercaptobenzoxazole, mercaptooxadiazole, 3-amino-5-benzylthio-1,2,4-triazole, or the mercapto compounds described in U.S. Pat. No. 4,123,274.

As the silver salts of imino group-containing compounds, there are typically the silver salts derived from benzotriazole and the derivatives thereof described in Japanese Patent Publication Nos. 30270/69 and 18416/70; alkyl-substituted benzotriazoles such as benzotriazole, methylbenzotriazole, etc.; halogen-substituted benzotriazoles such as 5-chlorobenzotriazole, etc.; carboimidobenzotriazoles such as butylcarboimidobenzotriazole, etc.; the nitrobenzotriazoles described in Japanese Patent Application (OPI) No. 118639/83; sulfobenzotriazole, carboxybenzotriazole or the salts thereof, and hydroxybenzotriazole described in Japanese Patent Application (OPI) No. 118638/83;

1,2,4-triazole and 1H-tetrazole described in U.S. Pat. No. 4,220,709; carbazole, saccharin, imidazole and the derivatives thereof.

Also, the silver salts and other organic metal salts than silver salts, such as copper stearate, etc., described in *Research Disclosure,* 17029 (June, 1978) and the silver salts of alkyl group-containing carboxylic acid, such as phenylpropiolic acid, etc., described in Japanese Patent Application No. 221535/83 (corresponding to U.S. patent application Ser. No. 675,040, filed on Nov. 26, 1984) can be used in this invention.

The above described organic silver salts are used in an amount of 0.01 to 10 mols, preferably 0.01 to 1 mol, per mol of light-sensitive silver halide. The total coating amount (coverage) of the light-sensitive silver halide and the organic silver salt is suitably 50 mg/m$^2$ to 10 g/m$^2$.

The silver halide emulsion for use in this invention may be spectrally sensitized by methine dyes, etc. Examples of the dyes which can be used for the purpose are cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes.

For these dyes can be applied nuclei which are usually utilized for cyanine dyes as basic heterocyclic nuclei. Examples of such nuclei are a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the nuclei formed by the fusion of the above described nuclei and an aliphatic hydrocarbon ring; and the nuclei formed by the fusion of the aforesaid nuclei and an aromatic hydrocarbon ring, such as an indolenine nucleus, a benzindolenine nucleus, an indole nucleus, a benzoxazole nucleus, a naphthoxazole nucleus, a benzothiazole nucleus, a naphthothiazole nucleus, a benzoselanazole nucleus, a benzimidazole nucleus, a quinoline nucleus, etc. These nuclei may have a substituent on the carbon atom(s).

For the merocyanine dyes or the complex merocyanine dyes may be applied a 5- or 6-membered heterocyclic nucleus such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc., as a nucleus having a ketomethylene structure.

These sensitizing dyes may be used solely or as a combination thereof and the combination of sensitizing dyes is frequently used for the purpose of super color sensitization.

The silver halide emulsion for use in this invention may further contain, together with the above described sensitizing dye(s), a dye which does not have a spectrally sensitizing action by itself or a material which does not substantially absorb visible light and shows a super color sensitization. Examples of such materials are aminostyryl compounds substituted by a nitrogen-containing heterocyclic group as described, for example, in U.S. Pat. Nos. 2,933,390, 3,635,721, etc., aromatic organic acid-formaldehyde condensation products as described, for example, in U.S. Pat. No. 3,743,510, etc., cadmium salts, azaindenes, etc. Also, the combinations of sensitizing dyes described in U.S. Pat. Nos. 3,615,613, 3,615,641, 3,617,295, 3,635,721, etc., are particularly advantageous.

These sensitizing dyes may be dispersed in a silver halide emulsion directly or as a solution in a solvent such as water, methanol, ethanol, acetone, methyl cellosolve, etc., or a mixture thereof. Also, after dissolving the sensitizing dye(s) in a solvent substantially immiscible with water such as phenoxyethanol, etc., the solution may be dispersed in water or an aqueous solution of a hydrophilic colloid and then the dispersion may be added to a silver halide emulsion. Furthermore, the sensitizing dye(s) may be mixed with a hydrophilic compound such as a dye providing substance,etc., and they may be simultaneously added to a silver halide emulsion. In the case of dissolving sensitizing dyes in a solvent as a mixture thereof, they may be added to the solvent as separate solutions thereof or may be added simultaneously as a mixture thereof. Also, in the case of adding sensitizing dyes to a silver halide emulsion, they may be added thereto separately or simultaneously or may be added thereto together with other additive(s).

The sensitizing dye(s) may be added to a silver halide emulsion before, during or after the chemical ripening thereof or may be before or after the formation of nuclei for the silver halide grains according to the method shown in U.S. Pat. Nos. 4,183,756 and 4,225,666.

The addition amount of the sensitizing dye(s) is about $10^{-8}$ to $10^{-2}$ mol per mol of silver halide.

In this invention it is preferred that the heat developable light-sensitive material contains a dye providing substance, i.e., a compound capable of forming or releasing a diffusible dye in proportion to or counterproportion to a reaction when the light-sensitive silver halide is reduced into silver under a high temperature state. The dye providing substance is explained in detail below.

As an example of the dye providing substance which can be used in this invention, there are first couplers capable of reacting with a developing agent. In the system of utilizing the coupler, a dye is formed by the reaction of the coupler and the oxidation product of a developing agent formed by the oxidation reduction reaction of a silver salt and the developing agent. Such a system is described in various literature, and practical examples of the developing agent and couplers are described, for example, in T. H. James, *The Theory of the Photographic Process,* 4th Ed., pages 291–334 and pages 354–361, Shinichi Kikuchi, *Shashin Kagaku (Photographic Chemistry)*, 4th Ed., pages 284–295 (published by Kyoritsu Shuppan Sha), etc.

Also, as another example of the dye providing substance, there is a dye-silver compound formed by the bonding of an organic silver salt and a dye. Practical examples of the dye-silver compounds which can be used in this invention are described in *Research Disclosure,* pages 54–58 (RD-16966), May, 1978, etc.

Also, still other examples of the dye providing substances are azo dyes which are used for a heat developing silver dye bleaching process.

Practical examples of the azo dyes and practical examples of the bleaching process are described in U.S. Pat. No. 4,235,957, *Research Disclosure,* pages 30–32 (RD-14433), April, 1976, etc.

Furthermore, other examples of the dye providing substances are leuco dyes described in U.S. Pat. Nos. 3,985,565, 4,022,617, etc.

Also, particularly preferred examples of the dye providing substances in this invention are compounds having a function of imagewise releasing or diffusing a diffusible dye, which are utilized for the system described in European Pat. No. 76,492.

The compound of this type is generally represented by general formula (LI):

$$(\text{Dye—X})_n\text{—Y} \qquad \text{(LI)}$$

wherein Dye represents a dye group or a dye precursor group; X represents a simple bond or a linkage group; Y represents a group having a property of causing a difference in diffusibility of the compound shown by $(\text{Dye—X})_n$—Y in proportion to or counterproportion to a light-sensitive silver salt having imagewise latent images or causing a difference in diffusibility between Dye released and $(\text{Dye—X})_n$—Y; and n represents; 1 or 2, when n is 2, two Dye—Xs may be the same or different.

As specific examples of the dye providing substances represented by general formula (LI) described above, there are dye developing agents each formed by the bonding of a hydroquinone series developing agent and a dye moiety as described in U.S. Pat. Nos. 3,134,764, 3,362,819, 3,597,200, 3,544,545, 3,482,972, etc. Also, materials releasing a diffusible dye by an intramolecular nucleophilic substitution reaction are described in Japanese Patent Application (OPI) No. 63618/76, etc., and materials releasing a diffusible dye by an intramolecular rearrangement reaction of an isoxazolone ring are described in Japanese Patent Application (OPI) No. 111628/74, etc.

In these systems, a diffusible dye is released or diffused in the portion that development did not occur and neither release nor diffusion of the dye occurs in the portion that development occurred.

Also, in these systems the release or diffusion of dye images occurs in parallel with the development and hence it is very difficult to obtain images having high S/N. Thus, for eliminating the disadvantage, there is proposed a system wherein a dye providing substance is incorporated in the heat developable light-sensitive material as an oxidized product thereof having no dye releasing property together with a reducing agent or a precursor therefor and after development the oxidized compound is reduced by the reducing agent to release a diffusible dye. Practical examples of the dye providing substance for use in this system are described in Japanese Patent Application (OPI) Nos. 110827/78, 130927/79, 164342/81, 35533/78, etc.

On the other hand, as the material of releasing a diffusible dye at the portions that development occurred, couplers having a diffusible dye as an eliminating group and materials releasing a diffusible dye by the reaction thereof with the oxidation product of a developing agent are described in British Pat. No. 1,330,524, Japanese Patent Publication No. 39165/73, U.S. Pat. No. 3,443,940, etc., and couplers having a nondiffusible group as an eliminating group and forming a diffusible dye by the reaction thereof with the oxidation product of a developing agent are described in U.S. Pat. No. 3,227,550, etc.

Also, since in the system of using such a color developing agent, staining of images by decomposed products formed by the oxidation of a developing agent is a serious problem, for dissolving this problem, a dye releasing compound having a reducing property by itself is proposed.

Specific examples of the dye providing substance are illustrated below together with the literature references describing the structure, the definitions in the formulae are described in the corresponding literature references.

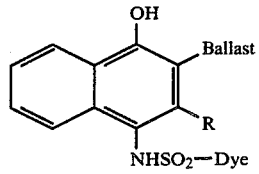

U.S. Pat. No. 3,928,312, etc.

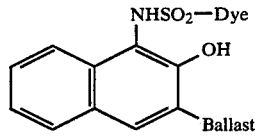

U.S. Pat. No. 4,053,312, etc.

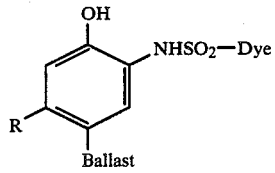

U.S. Pat. No. 4,055,428, etc.

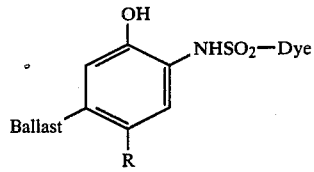

U.S. Pat. No. 4,336,322, etc.

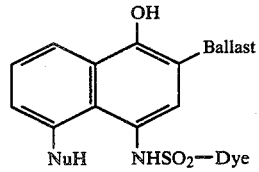

Japanese Patent Application (OPI) No. 65839/84

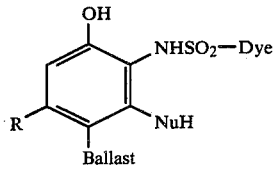

Japanese Patent Application (OPI) No. 69839/84

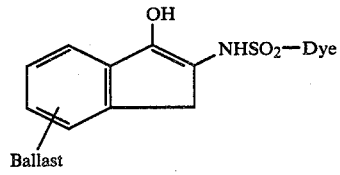

Japanese Patent Application (OPI) No. 3819/78

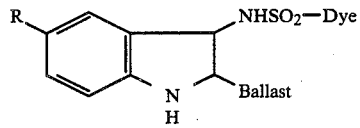

Japanese Patent Application (OPI) No. 104343/76

-continued

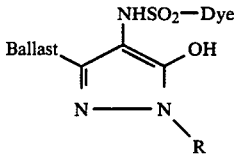

Japanese Patent Application (OPI) No. 104343/76

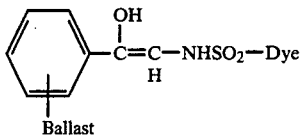

Japanese Patent Application (OPI) No. 104343/76

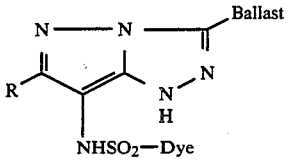

Research Disclosure, No. 17465

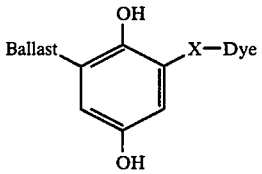

U.S. Pat. No. 3,725,062

-continued

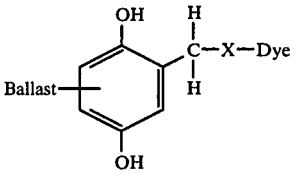

U.S. Pat. No. 3,728,113

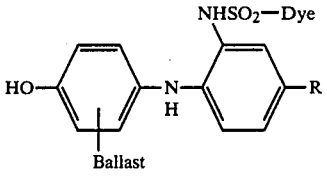

U.S. Pat. No. 3,443,939

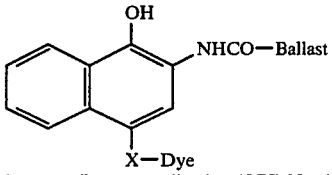

Japanese Patent Application (OPI) No. 116537/83

The various dye providing substances described above can be all used in this invention.

Practical examples of the image forming materials for use in this invention are described in the above described literature references. As a part of these materials, examples of the dye providing substances represented by general formula (LI) described above are illustrated below, although the invention is not limited to these compounds.

LI-1

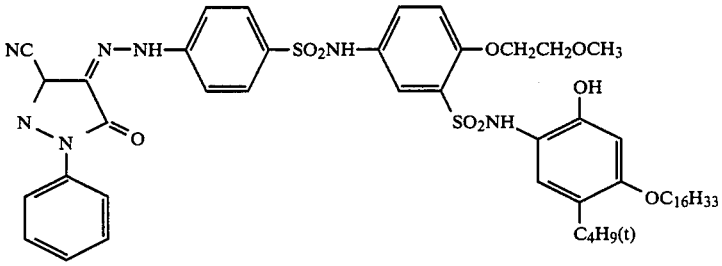

LI-2

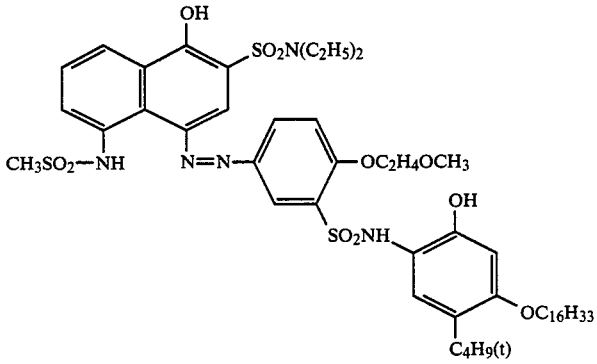

-continued
LI-3
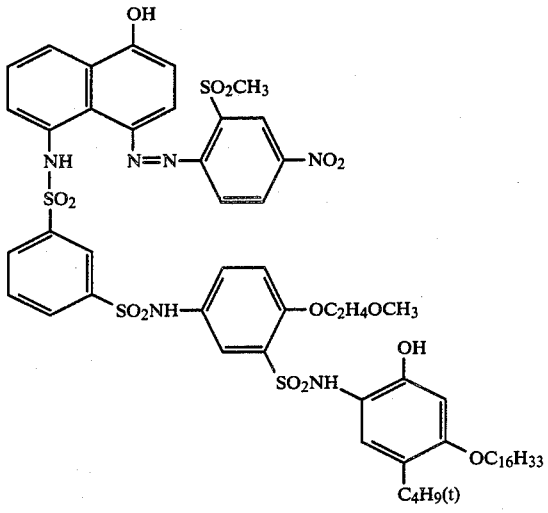
LI-4
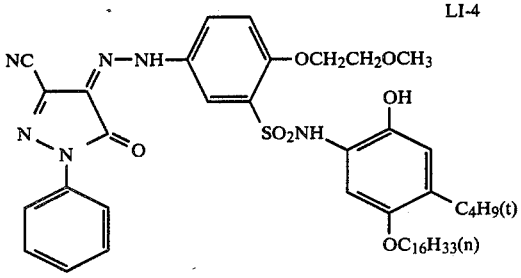
LI-5
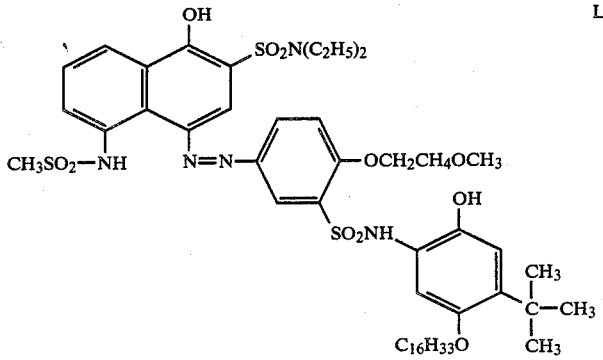
LI-6
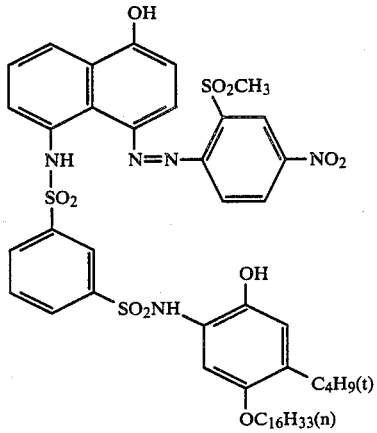
LI-7
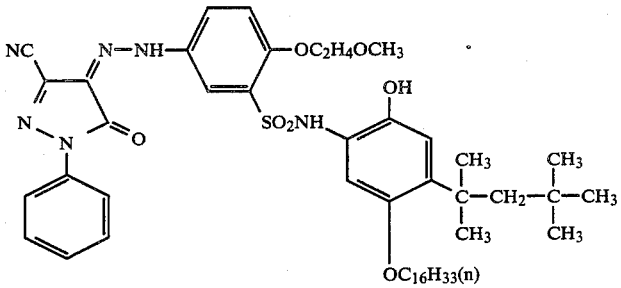
LI-8
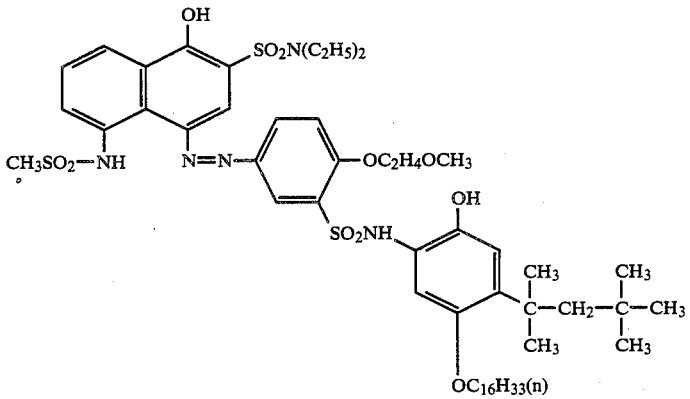

-continued
LI-9
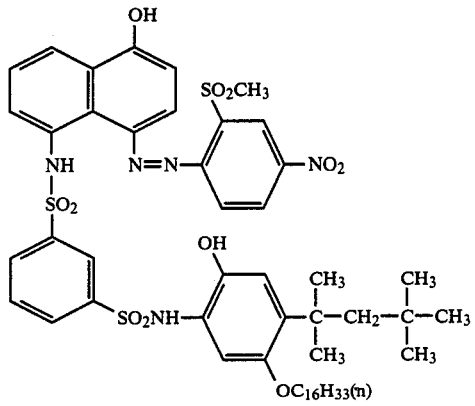
LI-10
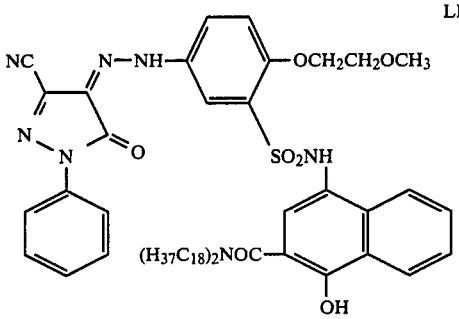
LI-11
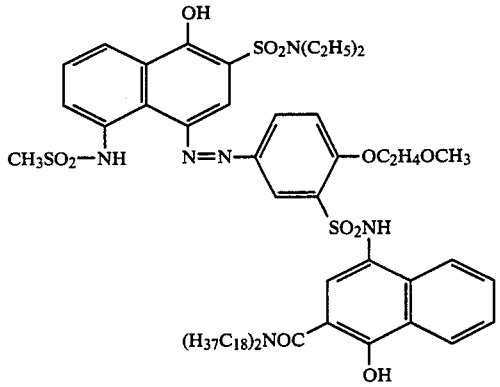
LI-12
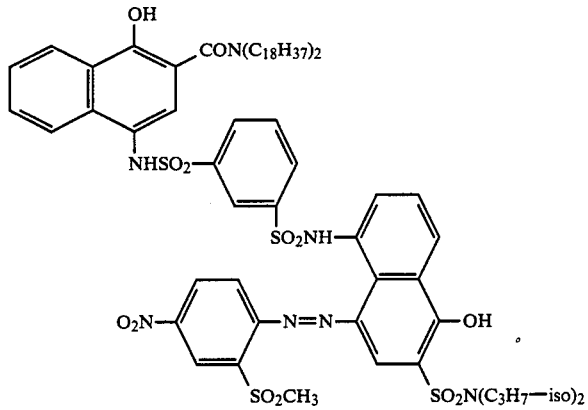
LI-13
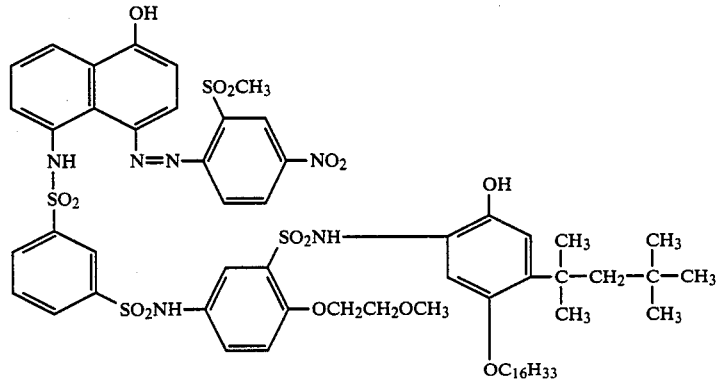

-continued

LI-14

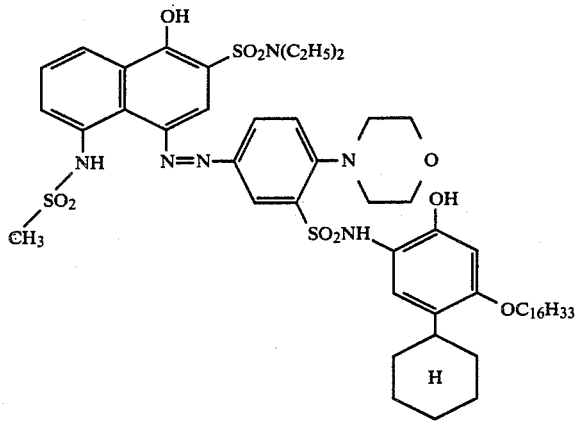

LI-15

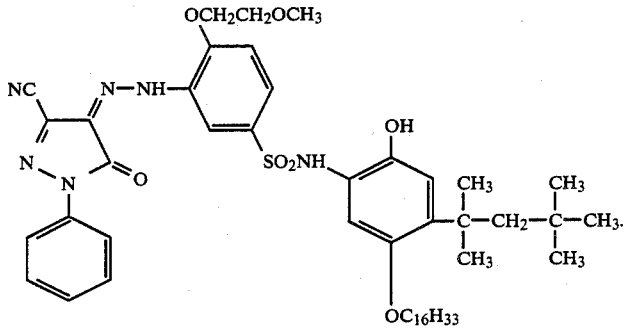

The dye providing substances for use in this invention can be introduced into the light-sensitive materials by the methods described in U.S. Pat. No. 2,322,027, etc. In this case, the following high boiling organic solvents and the low boiling organic solvents can be used.

Examples of the high boiling organic solvents are phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethyl succinate, dioctyl azelate, etc.), trimesic acid esters (e.g., tributyl trimesate, etc.), etc. Also, examples of the low boiling organic solvents are organic solvents having a boiling point of about 30° C. to 160° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, cyclohexanone, etc. The dye providing substance is dissolved in the aforesaid high boiling organic solvent or the low boiling organic solvent and then dispersed in a hydrophilic colloid. In this case, a mixture of the high boiling organic solvent and the low boiling organic solvent may be used.

Also, the dispersing method by polymers described in Japanese Patent Publication No. 39853/76 and Japanese Patent Application (OPI) No. 59943/76 (corresponding to U.S. Pat. Nos. 4,512,969, 4,247,627, 4,199,363, 4,304,769, 4,214,047, 4,203,716) can be used in this invention for dispersing the dye providing substance in a hydrophilic colloid. Furthermore, in the case of dispersing the dye providing substance in a hydrophilic colloid, various surface active agents as described hereinbefore in this specification can be used.

The amount of the high boiling organic solvent for use in this invention is less than 10 g, preferably less than 5 per gram of the dye providing substance.

It is preferred in this invention that the heat developable light-sensitive material contains a reducing material. The reducing material includes materials which are generally known as a reducing agent and also the above described dye providing substances having a reducing property. Also, a reducing agent precursor which does not have a reducing property by itself but shows a reducing property by the action of a nucleophilic reagent or heat during the development is used as the reducing material.

Examples of the reducing agent for use in this invention are inorganic reducing agents such as sodium sulfite, sodium hydrogensulfite, etc., and organic reducing agents such as benzenesulfinic acids, hydroxylamines, hydrazines, hydrazides, boran amine complexes, hydroquinones, aminophenols, catechols, p-phenylenediamines, 3-pyrazolidinones, hydroxy tetronic acids, ascorbic acids, 4-amino-5-pyrazolones, etc. Also, the reducing agents described in T. H. James, *The Theory of the Photographic Process*, 4th Ed., pages 291 to 334 can be used in this invention. Furthermore, the reducing agent precursors described in Japanese Patent Application (OPI) Nos 138736/81 (corresponding to U.S. Pat. No. 4,366,240), 40245/82, U.S. Pat. No. 4,330,617, etc., can also be used in this invention.

Also, combinations of various developing agents as described in U.S. Pat. No. 3,039,869 can be used as the reducing agent.

The amount of the reducing agent for use in this invention is 0.01 to 20 mols, preferably 0.1 to 10 mols, per mol of silver.

In this invention an image forming accelerator can be used. The image forming accelerator has a function of accelerating the oxidation reduction reaction of the silver salt oxidizing agent and the reducing agent, accelerating the reaction of the formation of a dye from the dye providing substance, decomposition of a dye, or release of a diffusible dye, and accelerating the transfer of a dye from the light-sensitive layer into a dye fixing layer. The image forming accelerators are classified into a base or a base precursor, a nucleophilic compound, an oil, a heat solvent, a surface active agent, a compound having an interaction with silver or silver ion, etc., by the chemical function thereof. The materials generally have composite functions, that is, having the above described plural accelerating effects together in one compound.

Examples of the image forming accelerators are classified by functions below. The functions are, however, for convenience sake and the materials each usually have the plural accelerating effects described above.

(a) Base

Examples of the preferred base are inorganic bases such as alkali metal or alkaline earth metal hydroxides; secondary or tertiary phosphates, borates, carbonates, metaborates, ammonium hydroxide, quaternary alkylammonium hydroxides, hydroxides of other metals, etc., and organic bases such as quinolinates, aliphatic amines (e.g., trialkylamines, hydroxylamines, aliphatic polyamines, etc.), aromatic amines (e.g., N-alkyl-substituted aromatic amines, N-hydroxyalkyl-substituted aromatic amines, bis[p-(dialkylamino)phenyl]methanes, etc.), heterocyclic amines, amidines, cyclic amidines, guanidines, cyclic guanidines, etc. The bases having a pKa of higher than 8 are preferably used.

(b) Base Precursor

As the base precursors, compounds releasing a base by causing a reaction by heating, such as a salt of an organic acid and a base, which is decomposed by causing decarboxylation by heating and a compound releasing an amine by being decomposed by an intramolecular nucleophilic substitution reaction. Lossen rearrangement, Beckmann rearrangement, etc., are preferably used. Examples of the preferred base precursors are salts of trichloroacetic acid described in British Pat. No. 998,949, etc., salts of $\alpha$-sulfonylacetic acid described in U.S. Pat. No. 4,060,420, etc., salts of propionic acids described in Japanese Patent Application (OPI) No. 180573/84, 2-carboxycarboxamide derivatives described in U.S. Pat. No. 4,088,496, salts of a thermally decomposable acid using an organic base and an alkali metal or alkaline earth metal as the base components described in Japanese Patent Application No. 69597/83 (corresponding to U.S. patent application Ser. No. 601,758, fined on Apr. 19, 1984), hydroxamcarbamates utilizung a Lossen rearrangement described in Japanese Patent Application (OPI) No. 168440/84, aldoximecarbamates forming nitrile by heating described in Japanese Patent Application (OPI) No. 157673/84, etc. Also, the base precursors described in British Pat. No. 998,945, U.S. Pat. No. 3,220,846, Japanese Patent Application (OPI) No. 22625/75, British Pat. No. 2,079,480, etc., can be used in this invention.

(c) Nucleophilic Compound

Examples of the nucleophilic compounds for use in this invention are water or water releasing compounds, amines, amidines, guanidines, hydroxylamines, hydrazines, hydrazides, oximes, hydroxamic acids, sulfonamides, active methylene compounds, alcohols, thiols, etc. Salts or precursors of the aforesaid compounds can also be used.

(d) Oil

The high boiling organic solvent (so-called plasticizers) which are used as solvents for dispersing a hydrophobic compound can be used.

(e) Heat Solvent

The heat solvent is a solid at an ambient temperature and is melted at about the developing temperature to function as solvent. Examples include ureas, urethanes, amides, pyridines, sulfonamides, sulfone, sulfoxides, esters, ketones, ethers, etc., which are solid at temperatures of lower than 40° C.

(f) Surface Active Agents

Examples of the surface active agent are pyridinium salts, ammonium salts, and phosphonium salts described in Japanese Patent Application (OPI) No. 74547/84 and polyalkylene oxides described in Japanese Patent Application (OPI) No. 57231/84.

(g) Compound Having Interaction with Silver or Silver Ion

Examples of these compounds are imides, nitrogen-containing heterocyclic rings described in Japanese Patent Application (OPI) No. 177550/84, thiols, thioureas, and thioethers described in Japanese Patent Application (OPI) No. 111636/84.

The image forming accelerator described above may be incorporated in the light-sensitive material and/or the dye fixing material. Also, the layer containing the image forming accelerator may be a silver halide emulsion layer, an interlayer, a protective layer, a dye fixing layer or a layer adjacent to the aforesaid layer. When a light-sensitive layer or light-sensitive layers and a dye fixing layer are formed on the same support, the image accelerating accelerator may be incorporated in a desired layer as described above.

The image forming accelerators may be used solely or as a mixture thereof but, in general, a better accelerating effect is obtained by using plural kinds of the accelerators.

Also, a particularly remarkable accelerating effect is obtained in the case of using the base or the base precursor and another accelerator.

In the compounds for use in this invention represented by general formula (I) described above, the compound having the compound shown by general formula (II) described above as PUG gives a particularly preferred effect in the case of using the base precursor. In this case, the ratio of the base precursor/the compound of this invention is preferably 1/20 to 20/1 more preferably 1/5 to 5/1, by mol ratio.

In this invention a compound capable of activating the development and at the same time stabilizing images formed can be used.

Preferred examples of the compounds are isothiuroniums such as 2-hydroxyethylisothiuronium. trichloroacetate described in U.S. Pat. No. 3,301,678, bis(isothiuronium)s such as 1,8-(3,6-dioxaoctane)-bis(isothuronium trichloroacetate), etc., described in U.S. Pat. No. 3,669,670, thiol compounds described in West German Patent Application (OLS) No. 2,162,714, thiazolium compounds such as 2amino-2-thiazolium trichloroacetate, 2-amino-5-bromoethyl-2-thiazolium trichloroacetate, etc., described in U.S. Pat. No. 4,012,260, and bis(2-amino-2-thiazolium)methylenebis(-sulfonylacetate), 2-amino-2-thiazoliumphenylsulfonyl acetate, 2-amino-2-thiazolium, 2-carboxycarboxyamide, etc., described in U.S. Pat. No. 4,060,420.

Furthermore, azole thioether compounds and blocked azolinethione compounds described in Belgian Pat. No. 768,071, 4-aryl-1-carbamyl-2-tetrazoline-5-thione compounds described in U.S. Pat. No. 3,893,859, and the compounds described in U.S. Pat. Nos. 3,839,041, 3,844,788 and 3,877,940 can also be preferably used as the aforesaid compounds.

Binders may be used solely or a combination thereof in this invention. A hydrophilic binder is used in this invention. The hydrophilic binders are typically transparent or translucent hydrophilic binders. Examples of the binders are natural materials such as proteins (e.g., gelatin, gelatin derivatives, cellulose derivatives, etc.) and polysaccharides such as starch, gum arabic, etc.; and synthetic polymers such as water-soluble polyvinyl compounds (e.g., polyvinylpyrrolidone, acrylamide polymers, etc.). As other synthetic polymers, there are dispersed vinyl compounds in a latex form capable of increasing the dimensional stability of the light-sensitive materials.

The coating amount of the binder is less than 20 g, preferably less than 10 g, more preferably less than 7 g, per $m^2$.

Also, the ratio of the high boiling organic solvent which is dispersed in a binder together with the hydrophobic compound(s) such as the dye providing substance(s) to the binder is less than 1 ml, preferably less than 0.5 ml, more preferably less than 0.3 ml, of the solvent per gram of the binder.

The photographic light-sensitive material and the dye fixing material for use in this invention may further contain an inorganic or organic hardening agent in the photographic emulsion layer(s) and other binder layers. Examples of the hardening agent are chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, 1,2-bis(vinylsulfonylacetamido)ethane, etc.), active halogen compounds (e.g., 2,4-dichloro-6-hydroxy-s-triazine, etc.), mucohalogenic acids (e.g., mucochloric acid, mucophenoxychloric acid, etc.), etc. They can be used solely or as a combination thereof.

As the support which is used for the light-sensitive material in this invention and also, as the case may be, for a dye fixing material in this invention, materials capable of enduring processing temperature can be used. In general, the support includes not only glass, papers, metals and the like but also films such as acetyl cellulose films, cellulose ester films, polyvinylacetal films, polystyrene films, polycarbonate films, polyethylene terephthalate films, etc., and other resin materials. Also, a paper support coated or laminated by a polymer such as polyethylene, etc., can be used. The polyesters described in U.S. Pat. Nos. 3,634,089 and 3,725,070 can be preferably used as the support in this invention.

When the dye providing substance imagewise releases a diffusible dye in this invention, a dye transfer assistant can be used for the dye transfer from the light-sensitive layer to the dye fixing layer.

As the dye transfer assistant, water or an aqueous basic solution containing an inorganic alkali metal salt such as sodium hydroxide, potassium hydroxide, etc., is used in the system of supplying the dye transfer assistant from outside. Also, for the purpose, a low boiling solvent such as methanol, N,N-dimethylformamide, acetone, diisobutyl ketone, etc., or a mixture of the low boiling solvent and water or an aqueous basic solution may be used. The dye transfer assistant may be used in a manner of wetting the image receiving layer with the dye transfer assistant.

When the dye transfer assistant exists in the light-sensitive material or the dye fixing material, it is unnecessary to supply a dye transfer assistant from outside.

In the latter case, the dye transfer assistant may be incorporated in the light-sensitive material or the dye fixing material as the form of water of crystallization or a microcapsulated form, or as a precursor releasing a solvent at high temperature. It is more preferred that a hydrophilic heat solvent which is solid at normal temperature but is melted at high temperature to provide a solvent is incorporated in the light-sensitive material or the dye fixing material. The hydrophilic heat solvent may be incorporated in either one of the light-sensitive material and the dye fixing material or may be incorporated in both the materials. Also, the layer(s) containing the hydrophilic heat solvent may be silver halide emulsion layer(s), an interlayer, a protective layer, and a dye fixing layer but it is preferred to incorporate the hydrophilic heat solvent in a dye fixing layer and/or a layer adjacent thereto.

Examples of the hydrophilic heat solvent are ureas, pyridines, amides, sulfonamides, imides, alcohols, oximes, and other heterocyclic rings.

The light-sensitive materials in this invention may contain the filter dyes or absorptive materials described in Japanese Patent Publication No. 3692/73, U.S. Pat. Nos. 3,253,921, 2,527,583, 2,956,879, etc., for improving the sharpness of image formed. Also, as these dyes, heat decoloring dyes are preferred and the dyes described in U.S. Pat. Nos. 3,769,019, 3,745,009 and 3,615,432 are preferably used.

The light-sensitive materials for use in this invention may further contain various additives which are known for heat developable light-sensitive materials and may have, in addition to light-sensitive layer(s), an antistatic layer, an electric conductive layer, a protective layer, an interlayer, an antihalation layer, a stripping layer, etc. As the additives, there are those described in *Research Disclosure,* Vol. 170, No. 17029, June, 1978, such as plasticizers, dyes for improving sharpness, antihalation dyes, sensitizing dyes, matting agents, surface active agents, brightening agents, anti-fading agents, etc.

The photographic element for use in this invention is composed of a light-sensitive element forming or releasing a dye by heat development and, if necessary, a dye fixing element for fixing the dye. In particular, in the system of forming images by the diffusion transfer of dye(s), a light-sensitive element and a dye fixing element are necessary and the typical embodiment is generally classified into an embodiment that a light-sensitive element and a dye fixing element are separately formed on two separate supports and an embodiment that these elements are formed on the same support.

The embodiment that a light-sensitive element and a dye fixing element are separately formed on separate supports is classified into a peel apart type and a non-peel apart type. In the case of the former peel apart type, after image exposure or after heat development, the coated surface of the light-sensitive element is superposed on the coated surface of the dye fixing element and after the formation of transferred images, the light-sensitive element is quickly peeled apart from the dye fixing element. According to whether the final images are of a reflection type or of a transparent type, an opaque support or a transparent support is selected as the support for the dye fixing element. Also, if necessary, a white reflection layer may be formed.

In the case of the latter non-peel apart type, it is necessary that a white reflection layer exists between a light-sensitive layer of the light-sensitive element and a dye fixing layer of the dye fixing element and the white reflection layer may be formed in either of the light-sensitive element and the dye fixing element. It is necessary in this case that the support for the dye fixing element is a transparent support.

The typical embodiment of forming the light-sensitive element and the dye forming element on the same support is that the light-sensitive element is not peeled apart from the image receiving element after the formation of transferred images. In this case, a light-sensitive layer, a dye fixing layer and a white reflection layer are formed on a transparent or opaque support. A preferred embodiment of the heat developable light-sensitive material of this invention is, for example, composed of a transparent or opaque support/light-sensitive layer/-white reflection layer/dye fixing layer or a transparent support/dye fixing layer/white reflection layer/light-sensitive layer.

In other typical embodiment of forming the light-sensitive layer and the dye fixing layer on the same support, the light-sensitive element is partially or wholly peeled apart from the dye fixing element and in this embodiment a stripping layer is formed at a proper position as described in Japanese Patent Application (OPI) No. 67880/81, Canadian Pat. No. 674,082, U.S. Pat. No. 3,730,718, etc.

In still another embodiment of this invention, the light-sensitive element or the dye fixing element has an electrically conductive heating layer as a heating means for heat development or diffusion transfer of dye.

In order to obtain colors of wide range in chromaticity diagram using the three primary colors yellow, magenta and cyan, it is necessary that the light-sensitive element for use in this invention has at least three silver halide emulsion layers each having a light sensitivity in each different spectral region.

Specific examples of the three light-sensitive silver halide emulsion layers each having light sensitivity in each different spectral region include a combination of a blue-sensitive emulsion layer, a green-sensitive emulsion layer, and a red-sensitive emulsion layer; a combination of a green-sensitive emulsion layer, a red-sensitive emulsion layer, and an infrared-sensitive emulsion layer; a combination of a blue-sensitive emulsion layer, a green-sensitive emulsion layer, and an infrared-sensitive emulsion layer; and a combination of a blue-sensitive emulsion layer, a red-sensitive emulsion layer, and an infrared-sensitive emulsion layer. The term "infrared-sensitive emulsion layer" means a silver halide emulsion layer having a light sensitivity for light having wavelengths of longer than 700 nm, particularly longer than 740 nm.

The light-sensitive material for use in this invention may, if necessary, have a silver halide emulsion layer having light sensitivity in the same spectral region as two or more separated layers according to the sensitivities of the silver halide emulsions.

It is necessary that each of the above described silver halide emulsion layers and/or each light-insensitive hydrophilic colloid layer adjacent to each silver halide emulsion layer contains each of the dye providing substance of forming or releasing a yellow hydrophilic dye, the dye providing substance of forming or releasing a magenta hydrophilic dye, and the dye providing substance of forming or releasing a cyan hydrophilic dye. In other words, it is necessary that each silver halide emulsion layer and/or each light-insensitive hydrophilic colloid layer adjacent to each emulsion layer contains each dye providing substance of forming or releasing a hydrophilic dye having each different hue.

If desired, two or more kinds of the dye providing substances of the same hue may be used as a mixture thereof. In particular, when the dye providing substances are colored from the first, it is advantageous to incorporate the dye providing substances in layers other than the silver halide emulsion layers.

The light-sensitive materials for use in this invention may have, in addition to the aforesaid layers, protective layers, interlayers, antistatic layers, curling preventing layers, stripping layers, matting layers, etc.

In particular, a protective layer usually contains an organic or inorganic matting agent for adhesion prevention. Also, the protective layer may further contain a mordant, an ultraviolet absorbent, etc. The protective layer and the interlayer each may be composed of two or more layers.

Also, the interlayer may further contain a reducing agent for color mixing prevention, an ultra-violet absorbent, or a white pigment such as titanium dioxide, etc. A white pigment may also be incorporated in a silver halide emulsion layer as well as an interlayer for increasing sensitivity.

For imparting each color sensitivity described above to each silver halide emulsion, the silver halide emulsion may be dye-sensitized by known sensitizing dye(s) so that the emulsion obtains a desired spectral sensitivity.

The dye fixing element for use in this invention has at least one layer containing a mordant and when the dye fixing layer is positioned at the surface, if necessary, a protective layer may be formed thereon.

Furthermore, if necessary, a sufficient amount of a dye transfer assistant may be incorporated in the above described layer or layers and for controlling the dye transfer assistant, a water absorbing layer or a dye transfer assistant-containing layer may be formed. Such a layer may be formed adjacent to the dye fixing layer directly or through an interlayer.

The dye fixing layer for use in this invention may be, if necessary, composed of two or more layers each containing a mordant having different mordanting power.

The dye fixing element for use in this invention may have, if necessary, auxiliary layers such as a stripping layer, a matting layer, a curling preventing layer, etc., in addition to the above described layers.

One or a plural of layers described above may further contain a base and/or a base precursor for accelerating transfer of dye, a hydrophilic heat solvent, an anti-fading agent for preventing the occurrence of color mixing of dyes, an ultraviolet absorbent, a vinyl compound in a dispersed state for increasing the dimensional stability of the layer, a brightening agent, etc.

The binder for the above described layers of the dye fixing element for use in this invention is preferably a hydrophilic binder, which is typically a transparent or translucent hydrophilic colloid. Examples of the binder are natural materials such as proteins (e.g., gelatin, gelatin derivatives, cellulsoe derivatives, etc.), polysaccharides (e.g., starch, dextrin, gum arabic, etc.), etc.; and synthetic polymers such as water-soluble polyvinyl compounds (e.g., pullulan, polyvinyl alcohol, polyvinylpyrrolidone, acrylamide polymer, etc.). In these materials, gelatin and polyvinyl alcohol are particularly effective.

The dye fixing element for use in this invention may have, if necessary, a reflection layer containing a white pigment such as titanium dioxide, etc., a neutralizing layer, a neutralization timing layer, etc., in addition to the above described layers. These layers may be also formed in the light-sensitive element as well as the dye fixing element. The detailed structures of the above described reflection layer, neutralizing layer, and neutralization timing layer are described, for example, in U.S. Pat. Nos. 2,983,606, 3,362,819, 3,362,821, 3,415,644, Canadian Pat. No. 928,559, etc.

Moreover, it is advantageous that the dye fixing element for use in this invention contains a dye transfer assistant described hereinbefore. The dye transfer assistant may exist in the above described dye fixing layer or in other addition layer in the dye fixing element.

When electric heating is employed as the developing means in this invention, a transparent or opaque heating element can be prepared as a resistance heating element by utilizing conventionally known techniques.

As a method for preparing the resistance heating element, there are a method of utilizing a thin film of an inorganic material showing semiconductivity and a method of utilizing a thin layer of an organic material composed of a binder and conductive fine particles dispersed therein.

As the material which can be utilized for the former method, there are silicon carbide, molybdenum silicate, lanthanum chromate, barium titanate ceramics, which are usually used for PTC (Positive Temperature Coefficient) thermistor, tin oxide, zinc oxide, etc., a transparent or opaque thin film can be formed using the above material by a known method.

In the latter method, a resistance element having desired temperature characteristics can be prepared by dispersing fine conductive particles such as fine metal particles, carbon black, graphite, etc., in rubber, a synthetic polymer, gelatin, etc.

The resistance element thus formed on the dye fixing element may be in contact with the light-sensitive element or may be separated therefrom by a support, an interlayer, etc.

As the image receiving layer for use in this invention, there is a dye fixing layer which is used for heat developable color light-sensitive materials and an ordinary mordant which is usually used for such heat developable light-sensitive materials can be used for the dye fixing layer. In particular, a polymer mordant is preferred. As the polymer mordant, there are a polymer containing a tertiary amino group, a polymer having a nitrogen-containing heterocyclic moiety, and a polymer having a quaternary cation group.

The polymers containing a vinyl monomer unit having a tertiary amino group are described in Japanese Patent Application (OPI) Nos. 60643/85, 57836/85, etc., and specific examples of the polymer containing a vinyl monomer unit having a tertiary imidazole group are described in Japanese Patent Application (OPI) Nos. 118834/85, 122941/85, U.S. Pat. Nos. 4,282,305, 4,115,124 3,148,061, etc.

Also, specific examples of the polymer containing a vinyl monomer unit having a quaternary imidazolium salt are described in British Pat. Nos. 2,056,101, 2,093,041, 1,594,961, U.S. Pat. Nos. 4,124,386, 4,115,124, 4,273,853, 4,450,224, Japanese Patent Application (OPI) No. 28225/73, etc.

Other preferred examples of the polymer containing a vinyl monomer unit having a quaternary ammonium salt are described in U.S. Pat. Nos. 3,709,690, 3,898,088, 3,958,995, Japanese Patent Application (OPI) Nos. 57836/85, 60643/85, 122940/85, 122942/85 and Japanese Patent Application No. 91620/84 (corresponding to U.S. patent application Ser. No. 731,695, filed on May 8, 1985), etc.

As an image exposure light source for recording images on the heat developable light-sensitive material in this invention, a radiation also containing visible light can be used. In general, a light source which is used for ordinary color printing, such as a tungsten lamp, etc., as well as other various light sources such as a mercury lamp, a halogen lamp (e.g., an iodine lamp, etc.), a xenon lamp, a laser light source, a CRT (cathode ray tube) light source, a fluorescent tube, a light emitting diode (LED), etc., can be used.

The heating temperature for the heat development step in this invention is as described hereinbefore but is preferably higher than 140° C., more preferably higher than 150° C., in the above described range. The heating temperature for the transfer step is in the range of from room temperature to the temperature for the heat development step but is preferably in the range of from more than 60° C. to a temperature of lower than the heat development temperature by about 10° C. As a heating means for the heat development step and/or the transfer step, a simple heat plate, heat iron, heat roller, a heating element utilizing carbon or titanium white, etc., can be used.

The dye transfer assistant (e.g., water, etc.) is for accelerating the transfer of dye images by being applied between the light-sensitive layer of the heat developable light-sensitive material and the dye fixing layer of the dye fixing material and in this case, after previously applying the dye transfer assistant to the light-sensitive layer and/or the dye fixing layer and then both the layers may be laminated.

Furthermore, the heating means for the transfer step includes: a heating means by passing the material(s) between hot plates or bringing them into contact with a hot plate (e.g., Japanese Patent Application (OPI) No. 62635/75), a heating by bringing them into contact with a heat drum or a heat roller while rotating the drum or roller (e.g., Japanese Patent Publication No. 10791/78), a heating means by passing the material(s) through a hot atmosphere (e.g., Japanese Patent Application (OPI) No. 32737/78), a heating means by passing the material(s) through an inert liquid maintained at a constant temperature, or a heating means by passing the material(s) along a heat source by means of a roller, a belt, or a guide member (e.g., Japanese Patent Publication No. 2546/69).

Also, a layer of a conductive material such as graphite, carbon black, a metal, etc., may be applied onto the dye fixing material and the material may be directly heated by passing electric current through the conductive layer.

The following examples are intended to illustrate this invention but not to limit it in any way.

EXAMPLE 1

A silver iodobromide emulsion was prepared as follows.

In 3,000 ml of water were dissolved 40 g of gelatin and 26 g of potassium bromide and the solution was stirred at 50° C. Then, a solution of 34 g of silver nitrate dissolved in 200 ml of water was added to the above described solution over a period of 10 minutes.

Thereafter, a solution of 3.3 g of potassium iodide dissolved in 100 ml of water was added to the above prepared solution over a period of 2 minutes.

The pH of the silver halide emulsion thus formed was adjusted to form deposits and excessive salts were removed. Thereafter, the pH was adjusted to 6.0 to provide 400 g of a silver iodobromide emulsion.

The preparation method for a gelatin dispersion of the dye providing substance (same as the above described image forming material) is described below.

To a mixture of 5 g of yellow dye providing substance (1) shown below and 0.5 g of succinic acid-2-ethylhexyl ester sodium sulfonate, 10 g of triisononyl phosphate, and 0.3 g of o-dodecyloxy thiophenol as surface active agents was added 30 ml of ethyl acetate and the mixture thus obtained was heated to about 60° C. to provide a homogeneous solution. The solution was mixed with 100 g of an aqueous solution of 10% limed gelatin with stirring and then the resulting mixture was dispersed for 10 minutes using a homogenizer at 10,000 rpm. Thus, a dispersion of yellow dye providing substance was obtained.

By following the same manner as above except that magenta dye providing substance (2) shown below was used, a dispersion of magenta dye providing substance was prepared. Also, by following the same procedure as above using cyan dye providing substance (3) shown below, a dispersion of cyan dye providing substance was prepared.

Yellow Dye Providing Substance (1)

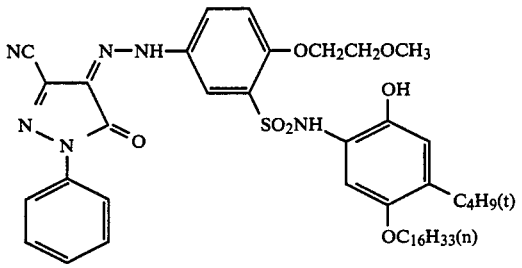

Magenta Dye Providing Substance (2)

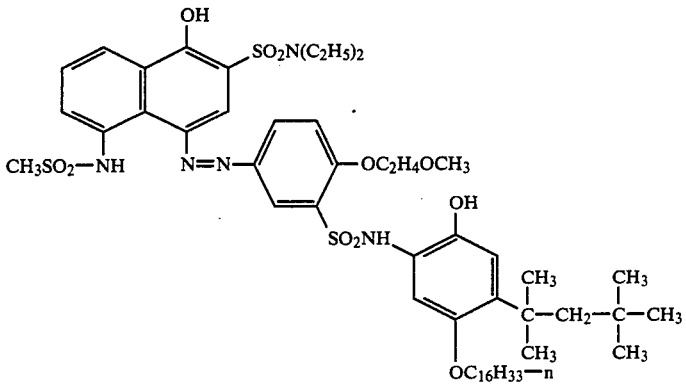

Cyan Dye Providing Substance (3)

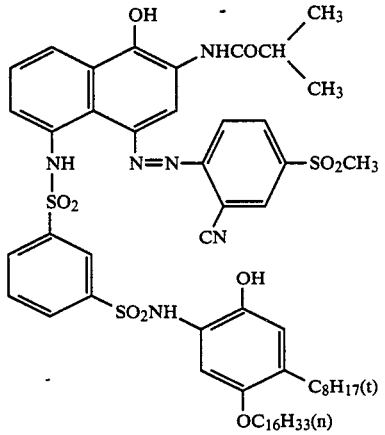

The preparation method of a gelatin dispersion of the compound for use in this invention represented by general formula (I) described above is described below.

To 100 g of an aqueous 1% gelatin solution was added 3 g of Compound (6) for use in this invention described hereinbefore and the compound in the solution was pulverized in a mill using 100 g of glass beads having a mean particle size of about 0.6 mm for 10 minutes. By filtering away the glass beads, a gelatin dispersion of the compound for use in this invention was obtained.

Then, by using the above described emulsions and dispersions, a multilayer color light-sensitive material A having the following layers on a support (polyethylene terephthalate of 100 μm in thickness) was prepared.

Layer 1: Red-Sensitive Emulsion Layer

A layer containing the silver iodobromide emulsion (iodine 10 mol%, silver coverage of 400 mg/m$^2$), the following compound*4 (coverage: 180 mg/m$^2$), sensitizing dye (D-2) shown below (coverage: $8\times10^{-7}$ mol/m$^2$), the following base precursor*3 (coverage: 515 mg/m$^2$), Compound (6) of this invention (coverage: 5 mg/m$^2$), cyan dye providing substance (3) shown above (coverage: 300 mg/m$^2$), gelatin (coverage: 1,000 mg/m$^2$), the high boiling solvent*1 shown below (coverage: 600 mg/m$^2$), the surface active agent*2 shown below (coverge: 100 mg/m$^2$), and the following compound*5 (coverage: 18 mg/m$^2$).

Layer 2: Interlayer

A layer containing gelatin (coverage: 1,000 mg/m$^2$), the following base precursor*3 (coverage: 230 mg/m$^2$), and Compound (6) of this invention (coverage: 10 mg/m$^2$).

Layer 3: Green-Sensitive Emulsion Layer

A layer containing the silver iodobromide emulsion (iodine 10 mol%, silver coverage: 400 mg/m$^2$), the following compound*4 (coverage: 180 mg/m$^2$), sensitizing dye (D-1) shown below (coverage: $10^{-6}$ mol/m$^2$), the following base precursor*3 (coverage: 515 mg/m$^2$), Compound (6) of the invention (coverage: 5 mg/m$^2$), magenta dye providing substance (2) shown above (coverage: 400 mg/m$^2$), gelatin (coverage: 1,000 mg/m$^2$), the high boiling solvent*1 shown below (coverage: 800 mg/m$^2$), the surface active agent*2 shown below (coverage: 100 mg/m$^2$), and the following compound*5 (coverage: 24 mg/m$^2$).

Layer 4: Interlayer

A layer containing gelatin (coverage: 1,200 mg/m$^2$), the base precursor*3 shown below (coverage: 220 mg/m$^2$), and Compound (6) of this invention (coverage: 10 mg/m$^2$).

Layer 5: Blue-Sensitive Emulsion Layer

A layer containing the silver iodobromide emulsion (iodine 10 mol%, silver coverage: 400 mg/m$^2$), the following compound*4 (coverage: 180 mg/m$^2$), the base precursor*3 shown below (coverage: 520 mg/m$^2$), Compound (6) of this invention (coverage: 5 mg/m$^2$), yellow dye providing substance (1) shown above (coverage: 400 mg/m$^2$), gelatin (coverage: 1,000 mg/m$^2$), the high boiling solvent*1 shown below (coverage: 800 mg/m$^2$), the surface active agent*2 shown below (coverage: 100 mg/m$^2$), and the following compound*5 (coverage: 24 mg/m$^2$).

Layer 6:

A layer containing gelatin (coverage: 1,000 mg/m$^2$), the base precursor*3 shown below (coverage: 220 mg/m$^2$), and Compound (6) of this invention (coverage: 10 mg/m$^2$).

*1 $(iso\text{-}C_9H_{19}O)_3P{=}O$

*2

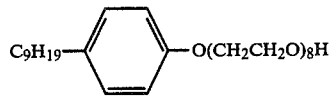

*3

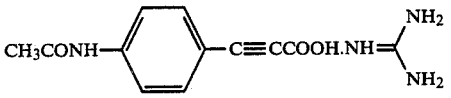

*4

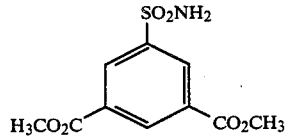

*5

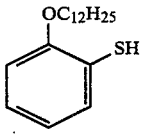

D-1

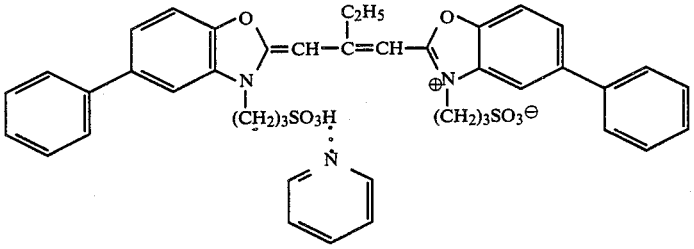

D-2

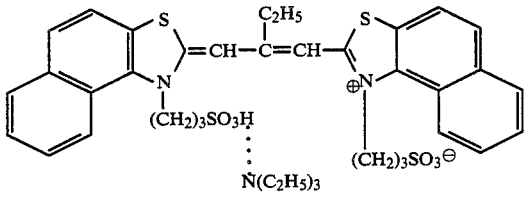

Then, by following the same procedure as the case of preparing light-sensitive material A using Compound (1) or (12) for use in this invention described hereinabove in place of Compound (6) for use in this invention, light-sensitive materials B and C were prepared respectively. Also, for comparison, light-sensitive material D was prepared by the same manner as above without using the compound for use in this invention.

The preparation method of an image receiving material having an image receiving layer is described below.

First, 0.57 g of gelatin hardening agent H-1 shown below, 0.25 g of gelatin hardening agent H-2 shown below, 160 ml of water, and 100 g of an aqueous 10% limed gelatin solution were uniformly mixed and the mixture thus obtained was uniformly coated on a paper support laminated with polyethylene having dispersed therein titanium dioxide at a wet thickness of 60 μm followed by drying.

Gelatin Hardening Agent H-1

$CH_2{=}CHSO_2CH_2CONHCH_2CH_2NHCOCH_2.SO_2CH{=}CH_2$

Gelatin Hardening Agent H-2

$CH_2{=}CHSO_2CH_2CONHCH_2.CH_2CH_2NHCOCH_2SO_2CH{=}CH_2$

Then, 15 g of the polymer having the structure shown below was dissolved in 200 ml of water and the solution was uniformly mixed with 100 g of a solution of 10% limed gelatin. The resulting mixture was uniformly coated on the above described coated layer at a wet thickness of 85 μm and dried to provide a dye fixing material.

Polymer

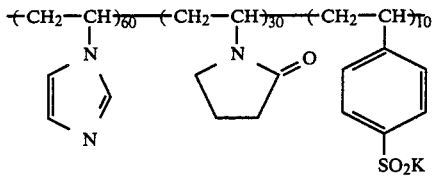

Each of the above described multilayer color light-sensitive materials was exposed for 10 seconds at 2,000 lux through three color separation filters of blue, green and red each having continuously changing density using a tungsten lamp and then uniformly heated for 20 seconds on a heat block heated to 150° C. or 153° C.

After immersing the image receiving material prepared above in water, each of the light-sensitive materials A to D thus heated was superposed on the image receiving material so that the coated layers were in contact with each other.

The assembly was heated on a heat block of 80° C. for 6 seconds and the image receiving material was peeled apart from the light-sensitive material, whereby negative magenta dye images were obtained on the image receiving material. The density of the negative images was measured by a Macbeth densitometer (RD-519) and the results thus obtained are shown in the following table.

| Sample | Compound* | Filter | Heating for 20 Sec at 150° C. Dmax | Heating for 20 Sec at 150° C. Dmin | Heating for 20 Sec at 153° C. Dmax | Heating for 20 Sec at 153° C. Dmin |
|---|---|---|---|---|---|---|
| A | (6) | Blue | 1.96 | 0.16 | 1.99 | 0.18 |
| | | Green | 2.03 | 0.19 | 2.07 | 0.22 |
| | | Red | 2.13 | 0.16 | 2.17 | 0.20 |
| B | (1) | Blue | 1.90 | 0.14 | 1.94 | 0.17 |
| | | Green | 2.02 | 0.17 | 2.05 | 0.20 |
| | | Red | 2.09 | 0.14 | 2.11 | 0.16 |
| C | (12) | Blue | 1.92 | 0.18 | 1.95 | 0.21 |
| | | Green | 2.01 | 0.18 | 2.03 | 0.20 |
| | | Red | 2.14 | 0.14 | 2.15 | 0.16 |

-continued

| Sample | Compound* | Filter | Heating for 20 Sec at 150° C. Dmax | Heating for 20 Sec at 150° C. Dmin | Heating for 20 Sec at 153° C. Dmax | Heating for 20 Sec at 153° C. Dmin |
|---|---|---|---|---|---|---|
| D** | None | Blue | 1.95 | 0.18 | 2.03 | 0.31 |
| | | Green | 2.04 | 0.20 | 2.16 | 0.41 |
| | | Red | 2.12 | 0.17 | 2.30 | 0.29 |

*Compound for use in this invention shown by general formula (I).
**Comparison sample:
Dmax: Maximum density, Dmin: Minimum density.

From the results shown above, it can be seen that the increase of the maximum density and the minimum density is less even when the development temperature is increased from 150° C. to 153° C. in the samples using the compounds of this invention, while the comparison sample containing no compound of this invention shows severe increase of fog. Accordingly, it can be seen that the compounds of this invention shown by formula (I) have a high temperature compensation effect.

EXAMPLE 2

The preparation method of a silver halide emulsion for layer 5 is described below.

To an aqueous well stirred gelatin solution (prepared by dissolving 20 g of gelatin and ammonia in 1,000 ml of water and maintaining the solution at 50° C.) were simultaneously added 1,000 ml of an aqueous solution containing potassium iodide and potassium bromide and a solution of silver nitrate (prepared by dissolving 1 mol of silver nitrate in 1,000 ml of water) with stirring well while maintaining a constant pAg to provide a monodispersed silver iodobromide octahedral emulsion (iodine 5 mol%) having a mean grain size of 0.5 μm.

After washing with water and removing salts, the silver halide emulsion was subjected to gold and sulfur sensitization at 60° C. with the addition of 5 mg of chloroauric acid (tetrahydrate) and 2 mg of sodium thiosulfate. The amount of the emulsion thus obtained was 1.0 kg.

The preparation method of a silver halide emulsion for layer 3 is described below.

To an aqueous gelatin solution (prepared by dissolving 20 g of gelatin and 3 g of sodium chloride in 1,000 ml of water and maintaining the solution at 75° C.) were simultaneously added 600 ml of an aqueous solution containing sodium chloride and potassium bromide, an aqueous silver nitrate solution (prepared by dissolving 0.59 mol of silver nitrate in 600 ml of water), and a dye solution (I) shown below over a period of 40 minutes. Thus, a monodispersed cubic silver chlorobromide emulsion (bromine 80 mol%) having a mean grain size of 0.35 μm and adsorbed with the dye was prepared.

After washing with water and removing salts, 5 mg of sodium thiosulfate and 20 mg of 4-hydroxy-6-methyl-1,3,3a,7-tetraazaindene were added to the emulsion and the chemical sensitization was performed at 60° C. The amount of the emulsion was 600 g.

Dye Solution (I)

-continued

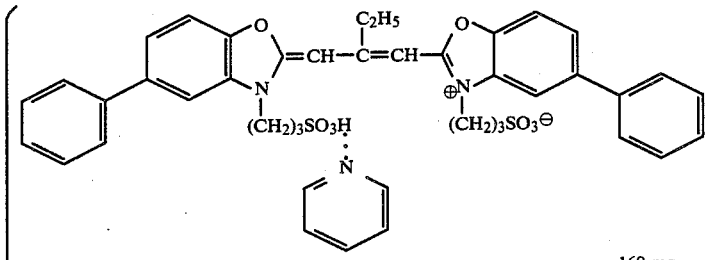

Methanol 160 mg 400 ml

The preparation method of a silver halide emulsion for layer 1 is described below.

To an aqueous well stirred gelatin solution (prepared by dissolving 20 g of gelatin and 3 g of sodium chloride in 1,000 ml of water and maintaining the solution at 75° C.) were simultaneously added 600 ml of an aqueous solution containing sodium chloride and potassium bromide and an aqueous silver nitrate solution (prepared by dissolving 0.59 mol of silver nitrate in 600 ml of water) over a period of 40 minutes. Thus, a monodispersed cubic silver chlorobromide emulsion (bromine 80 mol%) having a mean grain size of 0.35 μm was prepared.

After washing with water and removing salts, the emulsion was chemically sensitized with the addition of 5 mg of sodium thiosulfate and 20 mg of 4-hydroxy-6-methyl-1,3,3a,7-tetraazaindene at 60° C. The amount of the emulsion was 600 g.

The preparation method for a benzotriazole silver salt emulsion is described below.

In 3,000 ml of water were dissolved 28 g of gelatin and 13.2 g of benzotriazole and the solution was stirred at 40° C. Then, a solution of 17 g of silver nitrate dissolved in 100 ml of water was added to the above solution over a period of 2 minutes.

The pH of the emulsion thus obtained was adjusted to form deposits and excessive salts were removed. Then, the pH was adjusted to 6.0 to provide 400 g of a benzotriazole silver salt emulsion.

By using the above emulsions, light-sensitive material E having on a support (polyethylene terephthalate of 100 μm in thickness) the following layers were prepared.

Layer 1: Red-Sensitive Emulsion Layer

A layer containing the silver chlorobromide emulsion (bromine 80 mol%, silver coverage: 200 mg/m$^2$), benzenesulfamide (coverage: 140 mg/m$^2$), the sensitizing dye*9 shown below (coverage: $8\times10^{-7}$ mol/m$^2$), the benzotriazole silver salt emulsion (silver coverage: 230 mg/m$^2$), base precursor (A)*8 shown below (coverage: 230 mg/m$^2$), cyan dye providing substance (3) shown above (coverage: 300 mg/m$^2$), gelatin (coverage: 850 mg/m$^2$), the high boiling solvent*6 shown below (coverage: 540 mg/m$^2$), and the surface active agent*8 shown below (coverage: 50 mg/m$^2$).

Layer 2: Interlayer

A layer containing gelatin (coverage: 1,000 mg/m$^2$) and base precursor (A)*8 shown below (coverage: 240 mg/m$^2$).

Layer 3: Green-Sensitive Emulsion Layer

A layer containing the silver chlorobromide emulsion (bromine 80 mol%, silver coverage: 200 mg/m$^2$), benzenesulfamide (coverage: 140 mg/m$^2$), the benzotriazole silver salt emulsion (silver coverage: 100 mg/m$^2$), base precursor (A)*8 (coverage: 210 mg/m$^2$), magenta dye providing substance (2) shown above (coverage: 330 mg/m$^2$), gelatin (coverage: 860 mg/m$^2$), the high boiling solvent*6 shown below (coverage: 430 mg/m$^2$) and the surface active agent*7 shown below (coverage: 60 mg/m$^2$).

Layer 4: Interlayer

A layer containing gelatin (coverage: 700 mg/m$^2$) and base precursor (A)*8 shown below (coverage: 240 mg/m$^2$).

Layer 5: Blue-Sensitive Emulsion Layer

A layer containing the silver iodobromide emulsion (iodine 5 mol%, silver coverage: 500 mg/m$^2$), benzenesulfamide (coverage: 160 mg/m$^2$), base precursor (A)*8 shown below (coverage: 270 mg/m$^2$), the benzotriazole silver salt emulsion (silver coverage: 300 mg/m$^2$), yellow dye providing substance (1) shown above (coverage: 400 mg/m$^2$), gelatin (coverage: 1,200 mg/m$^2$), the high boiling solvent*6 shown below (coverage: 700 mg/m$^2$), and the surface active agent*7 shown below (coverage: 70 mg/m$^2$).

Layer 6:

A layer containing gelatin (coverage: 740 mg/m$^2$) and base precursor (A)*8 shown below (coverage: 250 mg/m$^2$).

$(iso\text{-}C_9H_{19}O)_3P{=}0$ *6

*7

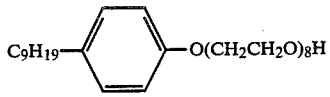

Base Precursor (A) *8

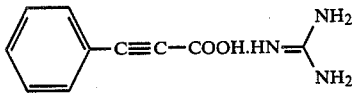

*9

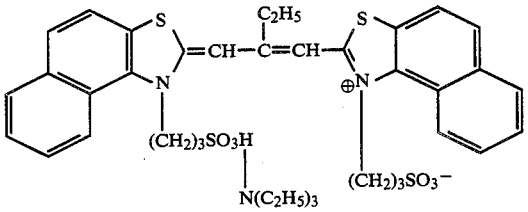

The preparation method of a dye fixing material is described below.

In 200 ml of water was dissolved 12 g of limed gelatin and 16 ml of an aqueous 0.5M zinc acetate solution was uniformly mixed with the above solution. The mixture thus obtained was uniformly coated on a white polyethylene terephthalate film of 100 μm in thickness containing titanium dioxide at a wet thickness of 85 μm. Then, the coating solution having the composition shown below was uniformly coated on the coated layer at a wet thickness of 90 μm and dried to provide a dye fixing material.

| Dye Fixing Layer Coating Composition F | |
|---|---|
| Aqueous solution of 10% polyvinyl alcohol (polymerization degree of 2,000) | 120 g |
| Urea | 20 g |
| N—Methylurea | 20 g |
| Aqueous solution of 12% 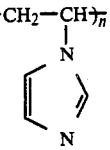 | 80 g |
| Compound (6) of the invention shown hereinbefore | 60 ml |
| **Dye Fixing Layer Coating Composition G** | |
| Aqueous solution of 10% polyvinyl alcohol (polymerization degree of 2,000) | 120 g |
| Urea | 20 g |
| N—Methylurea | 20 g |
| Aqueous solution of 12% 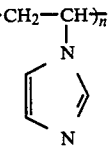 | 80 g |
| Water | 60 ml |

The color light-sensitive material of the multilayer structure described above was exposed for 1 second at 2,000 lux through three color separation filters of blue, green and red having continuously changed density using a tungsten lamp and then uniformly heated for 30 seconds on a heat block heated to 140° C.

The light-sensitive material was superposed on the dye fixing material prepared above so that the coated layers were in contact with each other and after passing through a heat roller of 130° C. under pressure, the assembly was immediately heated on a heat block at 120° C. for 30 seconds. When the dye fixing material was peeled apart from the light-sensitive material immediately after heating, yellow, magenta and cyan dye images were obtained on the dye fixing material corresponding to the three color separation filters of blue, green and red. The maximum density (Dmax) and the minimum density (Dmin) of each color images were measured using a Macbeth reflection type densitometer (RD-519). The results are shown in the following table.

| Color Separation Filter | Dye Fixing Layer Coating Composition F (Invention) | | Dye Fixing Layer Coating Composition G (Comparison) | |
|---|---|---|---|---|
| | Dmax | Dmin | Dmax | Dmin |
| Blue | 1.89 | 0.17 | 1.90 | 0.28 |
| Green | 2.04 | -0.19 | 2.12 | 0.32 |

-continued

| Color Separation Filter | Dye Fixing Layer Coating Composition F (Invention) | | Dye Fixing Layer Coating Composition G (Comparison) | |
|---|---|---|---|---|
| | Dmax | Dmin | Dmax | Dmin |
| Red | 2.23 | 0.13 | 2.25 | 0.29 |

From the results shown above, it can be seen that the addition of the compound of this invention to the dye fixing layer has an effect of restraining the increase of fog during the transfer step.

EXAMPLE 3

To 10 g of dye providing substance (4) shown below, 0.5 g of succinic acid-2-ethylhexyl ester sodium sulfonate, and 10 g of tricresyl phosphate was added 20 ml of cyclohexanone and the mixture was heated to 60° C. to provide a homogeneous solution. The solution was mixed with 100 g of an aqueous 10% limed gelatin solution and the mixture was dispersed using a homogenizer.

Dye Providing Substance (4)

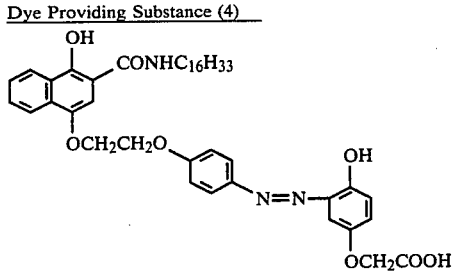

Then, light-sensitive material H was prepared as follows.

| | | |
|---|---|---|
| (a) | Silver iodobromide emulsion as in Example 1 | 5.5 g |
| (b) | Aqueous 10% gelatin solution | 0.5 g |
| (c) | Dispersion of the above described dye providing substance | 2.5 g |
| (d) | Ethanol solution of 10% guanidine-trichloroacetic acid | 1 ml |
| (e) | Methanol solution of 10% 2,6-dichloro-4-aminophenol | 0.5 ml |
| (f) | Aqueous 5% solution of the compound having the following structure 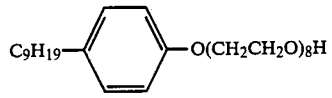 | 1 ml |
| (g) | Gelatin dispersion of Compound (6) of this invention | 0.5 ml |
| (h) | Water | 6 ml |

The above described components (a) to (h) were mixed and heated to provide a homogeneous solution and then the solution was coated on a polyethylene terephthalate film at a wet thickness of 85 μm and then a gelatin solution was coated on the coated layer at a coverage of 1.5 g/m$^2$ as a protective layer to provide light-sensitive material H.

The above described light-sensitive material H was imagewise exposed for 10 seconds at 2,000 lux using a tungsten lamp and then uniformly heated for 30 seconds on a heat block heated to 140° C. or 143° C.

Then, the light-sensitive material was processed as in Example 1. The results thus obtained are shown in the following table.

| | Heating for 30 Sec at 140° C. | | Heating for 30 Sec at 143° C. | |
|---|---|---|---|---|
| | Dmax | Dmin | Dmax | Dmin |
| H | 2.00 | 0.17 | 2.04 | 0.19 |

From the results shown above, it can be seen that in the light-sensitive material containing the dye providing substance releasing a dye by a coupling reaction with the oxidation product of a developing agent, the effect of the compound of this invention is remarkable.

EXAMPLE 4

To 5 g of dye providing substance (5) having the structure shown below, 4 g of the electron donor having the structure shown below, 0.5 g of succinic acid-2-ethylhexyl ester sodium sulfonate, and 10 g of tricresyl phosphate was added 20 ml of cyclohexanone and the mixture was heated to about 60° C. to provide a homogeneous solution. Then, using the solution, a dispersion of a reducible dye providing substance was prepared by the same manner as in Example 3.

Dye Providing Substance (5)

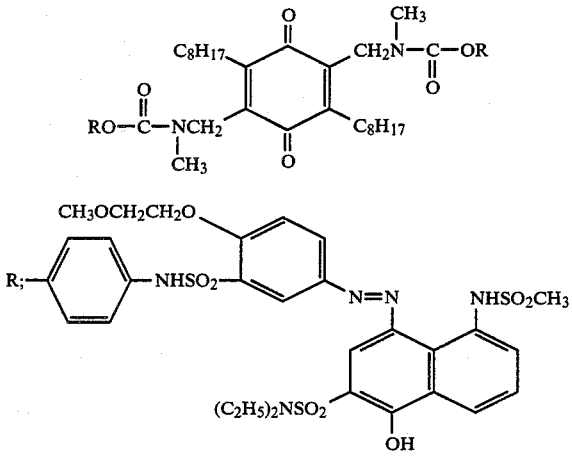

Electron Donor

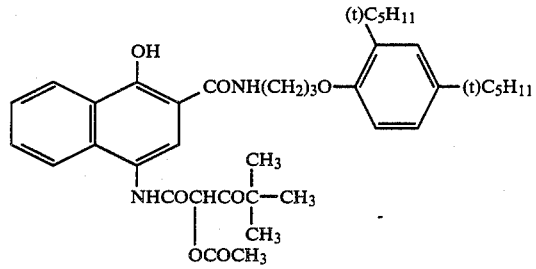

By following the same procedure as the case of preparing light-sensitive material H in Example 3 except that the aforesaid dispersion of the reducible dye providing substance was used in place of the dispersion of dye providing substance (4) in Example 3, light-sensitive material I was prepared.

Light-sensitive material I was exposed and processed as in Example 3 and the measurement was performed as in Example 3. The results obtained are shown in the following table.

| | Heating for 30 Sec at 140° C. | | Heating for 30 Sec at 143° C. | |
|---|---|---|---|---|
| | Dmax | Dmin | Dmax | Dmin |
| I | 1.84 | 0.17 | 1.87 | 0.21 |

From the above results, it can be seen that in the light-sensitive material containing the aforesaid reducible dye providing substance capable of forming positive images for silver images, the effect of the compound of this invention is confirmed.

EXAMPLE 5

Preparation of Gelatin Dispersion of Coupler:

To 5 g of 2-dodecylcarbamoyl-1-naphthol, 0.5 g of succinic acid-2-ethylhexyl ester sodium sulfonate, and 2.5 g of tricresyl phosphate (TCP) was added 30 m of ethyl acetate and the mixture was stirred to provide a homogeneous solution. The solution was mixed with 100 g of an aqueous 10% gelatin solution with stirring and the mixture was dispersed for 10 minutes by means of a homogenizer at 10,000 rpm.

By using the dispersion, light-sensitive material J was prepared as follows.

| | | |
|---|---|---|
| (a) | Silver iodobromide emulsion as in Example 1 | 10 g |
| (b) | Gelatin dispersion of coupler prepared above | 3.5 g |
| (c) | Solution of 0.25 g of guanidine-trichloroacetic acid in 2.5 ml of ethanol | |
| (d) | Aqueous 10% gelatin solution | 5 g |
| (e) | Solution of 0.2 g of 2,6-dichloro-p-aminophenol in 15 ml of water | |
| (f) | Gelatin dispersion of Compound (6) of this invention (as shown in Example 1) | 1 ml |

The coating composition composed of the above described components was coated on a polyethylene terephthalate support at a wet thickness of 60 μm and dried to provide light-sensitive material J.

The light-sensitive material was imagewise exposed for 5 seconds at 2,000 lux using a tungsten lamp and then uniformly heated on a heat block heated to 150° C. or 153° C., whereby negative cyan dye iamges were obtained. The densities were measured by a Macbeth transmission densitometer (TD-504) and the results are shown in the following table.

| | Heating for 20 Sec at 150 ° C. | | Heating for 20 Sec at 153° C. | |
|---|---|---|---|---|
| | Dmax | Dmin | Dmax | Dmin |
| J | 2.12 | 0.33 | 2.15 | 0.24 |

From the results shown above, it can be seen that the compound of this invention has a high temperature compensating effect.

EXAMPLE 6

The case of forming black-and-white images is described below.

Light-sensitive material K was prepared as follows.

| | | |
|---|---|---|
| (a) | Silver iodobromide emulsion as in Example 1 | 1 g |
| (b) | Benzotriazole silver salt emulsion as in Example 2 | 10 g |
| (c) | Ethanol solution of 10% guanidine-trichloroacetic acid | 1 ml |
| (d) | Methanol solution of 5% compound having the following structure 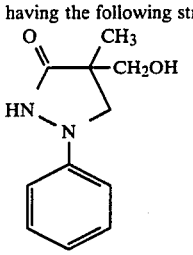 | 2 ml |
| (e) | Gelatin dispersion of Compound (6) of this invention as in Example 1 | 1 ml |

The coating composition composed of the above components was coated on a polyethylene terephthalate support at a wet thickness of 60 μm to provide light-sensitive material K.

The light-sensitive material was imagewise exposed for 5 seconds at 2,000 lux using a tungsten lamp and then uniformly heated on a heat block heated to 130° C. or 133° C. for 30 seconds, whereby negative brown images were obtained. The densities were measured by a Macbeth transmission densitometer (TD-504). The results obtained are shown in the following table.

| | Heating for 30 Sec at 130° C. | | Heating for 30 Sec.at 133° C. | |
|---|---|---|---|---|
| | Dmax | Dmin | Dmax | Dmin |
| K | 0.76 | 0.12 | 0.79 | 0.15 |

Froam the above results, it can be seen that the compound of this invention has a high temperature compensating effect even in the case of forming black-and-white (brown) images.

While the invention has been described in detail and with reference to specific embodiments thereof, it will be apparent to one skilled in the art that various changes and modifications can be made therein without departing from the spirit and scope thereof.

What is claimed is:

1. A process of forming images by heat developing a heat developable light-sensitive material after imagewise exposure, comprising heating a heat developable light-sensitive material in the presence of a nucleophilic reagent and a compound represented by general formula (I):

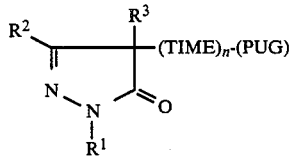

(I)

wherein $R^1$ represents a group represented by the following groups (A) to (C)

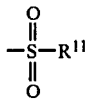

(A)

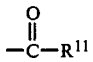

(B)

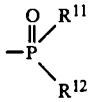

(C)

wherein $R^{11}$ and $R^{12}$, which may be the same or different in formula (C), each represents a substituted or unsubstituted alkyl group, a substituted or unsubstituted cycloalkyl group, a substituted or unsubstituted alkenyl group, a substituted or unsubstituted aralkyl group, a substituted or unsubstituted aryl group, a substituted or unsubstituted heterocyclic residue, a substituted or unsubstituted alkyloxy group, a substituted or unsubstituted aryloxy group, a substituted or unsubstituted alkylthio group, a substituted or unsubstituted arylthio group, or a substituted or unsubstituted amino group; said $R^{11}$ and $R^{12}$ may combine with each other to form a 5-membered or 6-membered ring in formula (C);

$R^2$ represents a hydrogen atom, a substituted or unsubstituted alkyl group, a substituted or unsubstituted cycloalkyl group, a substituted or unsubstituted aralkyl group, a substituted or unsubstituted heterocyclic residue, a substituted or unsubstituted alkyloxy group, a substituted or unsubstituted aryloxy group, a substituted or unsubstituted alkylthio group, a substituted or unsubstituted arylthio group, a substituted or unsubstituted amino group, a substituted or unsubstituted carbamoyl group, a carboxy group, an acylamino group, an acyloxy group, a sulfonylamino group, a cyano group, an alkyloxycarbonyl group, or an aryloxycarbonyl group;

$R^3$ represents a substituted or unsubstituted alkyl group, a substituted or unsubstituted cycloalkyl group, a substituted or unsubstituted aralkyl group, a substituted or unsubstituted aryl group, a substituted or unsubstituted heterocyclic residue, or a group shown by $-(TIME)_n-(PUG)$;

said $R^2$ and $R^3$ may combine with each other to form a 5-membered or 6-membered ring;

TIME represents a timing group;

PUG represents a photographically useful group; and n represents an integer of 0 to 3.

2. A process as claimed in claim 1, wherein the alkyl group shown by $R^{11}$, $R^{12}$, $R^2$ and $R^3$ is a straight chain or branched alkyl group having 1 to 18 carbon atoms.

3. A process as claimed in claim 1, wherein the cycloalkyl group shown by $R^{11}$, $R^{12}$, $R^2$ and $R^3$ is a 5- or 6-membered cycloalkyl group having 5 to 10 carbon atoms.

4. A process as claimed in claim 1, wherein the aryl group shown by $R^{11}$, $R^{12}$, $R^2$ and $R^3$ has 6 to 18 carbon atoms.

5. A process as claimed in claim 1, wherein the heterocyclic residue shown by $R^{11}$, $R^{12}$, $R^2$ and $R^3$ is a 5- or a 6-membered heterocyclic group containing an oxygen atom, a nitrogen atom or a sulfur atom as the hetero atom.

6. A process as claimed in claim 1, wherein (PUG) is selected from the group consisting of an antifoggant, a development inhibitor, a developing agent, a developing accelerator, an electron donor, a fogging agent, a nucleating agent, a silver halide solvent, a bleach accelerator, a blix accelerator, a fix accelerator, a dye, a coloring agent for color diffusion transfer process, a coupler, a melting point depressant for light-sensitive materials and a coupling inhibitor for diazo heat photography.

7. A process as claimed in claim 6, wherein said development inhibitor is represented by general formula (II)

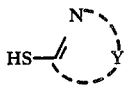

wherein Y represents an atomic group necessary for forming a 5-membered or 6-membered heterocyclic ring, wherein said heat-developable light-sensitive material is a silver halide light-sensitive material.

8. A process as claimed in claim 1, wherein said compound is employed in an amount of less than 50% by weight based on the weight of the coating.

9. A process as claimed in claim 8, wherein said compound is employed in an amount of less than 30% by weight based on the weight of the coating.

10. A process as claimed in claim 1, wherein said compound represented by general formula (I) is incorporated in a heat developable light-sensitive material.

11. A process as claimed in claim 1, wherein said heat developable light-sensitive material is composed of a light-sensitive silver halide as a light-sensitive element.

12. A process as claimed in claim 1, wherein said heat developable light-sensitive material is composed of a light-sensitive silver halide, a binder, and a dye providing substance.

* * * * *